US007422026B2

(12) United States Patent
Kim

(10) Patent No.: US 7,422,026 B2
(45) Date of Patent: Sep. 9, 2008

(54) STRUCTURE OF CANOPY

(76) Inventor: Dae Hwan Kim, 546-1 Songhym2-dong, Dalseo-gu, Daegu (KR)

( * ) Notice: Subject to any disclaimer, the term of this patent is extended or adjusted under 35 U.S.C. 154(b) by 151 days.

(21) Appl. No.: 10/500,926

(22) PCT Filed: Jan. 7, 2003

(86) PCT No.: PCT/KR03/00021

§ 371 (c)(1),
(2), (4) Date: Mar. 11, 2005

(87) PCT Pub. No.: WO03/058010

PCT Pub. Date: Jul. 17, 2003

(65) Prior Publication Data

US 2005/0155637 A1 Jul. 21, 2005

(51) Int. Cl.
*E04H 15/50* (2006.01)

(52) U.S. Cl. ..... 135/131; 135/145; 135/120.2

(58) Field of Classification Search ..... 135/145, 135/144, 143, 147, 131, 126, 97, 93, 94
See application file for complete search history.

(56) References Cited

U.S. PATENT DOCUMENTS

| | | | | | |
|---|---|---|---|---|---|
| 4,945,936 | A * | 8/1990 | Surrendi | 135/98 |
| 5,274,980 | A * | 1/1994 | Zeigler | 52/646 |
| 5,421,356 | A * | 6/1995 | Lynch | 135/145 |
| 5,490,532 | A * | 2/1996 | Mallookis et al. | 135/117 |
| 5,638,853 | A | 6/1997 | Tsai | 135/145 |
| 5,794,640 | A | 8/1998 | Jang | 135/131 |
| 5,944,040 | A | 8/1999 | Jang | 135/126 |
| 6,138,702 | A * | 10/2000 | Carter | 135/145 |
| 6,152,157 | A * | 11/2000 | Jang | 135/131 |
| 6,223,482 | B1 | 5/2001 | Zohar | 52/109 |
| 6,240,940 | B1 * | 6/2001 | Carter | 135/145 |
| 6,516,823 | B1 * | 2/2003 | Glover et al. | 135/94 |
| 6,575,656 | B2 * | 6/2003 | Suh | 403/109.6 |
| 2002/0074032 | A1 * | 6/2002 | Park et al. | 135/131 |
| 2007/0119494 | A1 * | 5/2007 | Carter | 135/145 |

* cited by examiner

FOREIGN PATENT DOCUMENTS

KR 1998-067221 12/1998

OTHER PUBLICATIONS

First Office Action Notification of counterpart Peoples Republic of China Application No. 0038053705, dated Dec. 2, 2005.

*Primary Examiner*—David R Dunn
*Assistant Examiner*—Noah Chandler Hawk
(74) *Attorney, Agent, or Firm*—Morgan & Finnegan, LLP

(57) ABSTRACT

A structure of a canopy includes a plurality of pillars, an end portion connection block fixed to an end portion of the pillar, a slide connection block capable of sliding along the pillar, a plurality of roof edge frames, a plurality of roof center frames, a rod connection block connecting the roof edge frame and the roof center frame, an upper head connection block pivoting with respect to the first rod of each of the roof center frames to form an outer top end of the roof, a lower head connection block pivoting with respect to the second rod of each of the roof center frames to form an inner top end of the roof, a connection block including a corner reinforcement bar capable of being hinge coupled between the roof end connection block and the upper head connection block to reinforce a corner formed to face the center of the roof, and a roof cloth covering the roof edge frame and the roof center frame.

13 Claims, 28 Drawing Sheets

STRUCTURE OF CANOPY

BACKGROUND OF THE INVENTION

1. Field of the Invention

The present invention relates to the structure of a canopy, and more particularly, to the structure of a canopy which is firm, has an aesthetic appearance, and is used in various ways.

2. Description of the Related Art

In general, a simple sun shield or a simple house, that is, a canopy, in which a frame is set up to a predetermined height and a roof is covered over the frame to shield wind or sunshine outdoors, is widely used in camping areas, street events, or athletic meetings. The canopy is built by setting up pillars, connecting roof edge frames and roof center frames in a hinge type by using a plurality of connection blocks, covering the frames with roof cloth.

However, since the roof edge frames and the roof center frames are made of rods having the same length in an X structure, the appearance of the roof is flat, or a simple conic shape by installing a vertical rod at the center of the roof. Thus, the appearance is not aesthetic. Also, since the line of the edge of a roof is not distinctive, the roof cloth sags so that water drainage is not easy and the entire structure is weak.

Also, using the roof by extending it is difficult. When a user manipulates a snap button, a finger of the user may be damaged. Since ventilation of a roof is not smooth, air does not circulate well inside. Also, producing luxury products is difficult.

SUMMARY OF THE INVENTION

To solve the above and other problems, the present invention provides the structure of a canopy in a variety of shapes, by which the inner side surface and the center of the top end of a roof is made pointed without an additional vertical rod by using a difference in the length of rods. The structure of a canopy can be applied to a pyramid type roof, a slate (gable) type roof, a cross type roof, a cross-pyramid type roof, and a modified cross-pyramid type roof according to various shape and type of roofs. Thus, smooth drainage and aesthetic appearance are possible. Also, by reinforcing the edge of a roof, smooth drainage is possible and the canopy is strong to an external force.

Also, the present invention provides the structure of a canopy by which a roof can be extended in multiple units of roofs and a user can conveniently use a key lever. Also, by forming a ventilating opening and a sunshield roof on the roof, air circulation inside the canopy is made smooth and temperature can be controlled. Further, products can be made luxury.

According to an aspect of the present invention, a structure of a canopy comprising a plurality of pillars erected on the ground, an end portion connection block fixed to an end portion of the pillar, a slide connection block capable of sliding along the pillar, a plurality of roof edge frames, each supporting an edge of a roof and including a first rod pivoting with respect to the end portion connection block of the pillar and a second rod pivoting with respect to the slide connection block, so that a center portion of the first and second rods pivots in X form capable of being hinge coupled, a plurality of roof center frames, each supporting a center portion of the roof and including a first rod pivoting with respect to the end portion connection block of the first rod of the roof edge frame and a second rod pivoting with respect to the end portion connection block of the second rod of the roof edge frame, so that a center portion of the first and second rods pivots in X form capable of being hinge coupled, a rod connection block connecting the roof edge frame and the roof center frame, an upper head connection block pivoting with respect to the first rod of each of the roof center frames to form an outer top end of the roof, a lower head connection block pivoting with respect to the second rod of each of the roof center frames to form an inner top end of the roof, and a roof cloth covering the roof edge frame and the roof center frame.

To make the upper head connection block disposed higher than the height of a horizontal level of the roof edge frame when the canopy is open, the rod of the roof center frame is longer than the rod of the roof edge frame and the first rod of the roof center frame is longer than the second rod of the roof center frame.

A corner facing the center of the roof is formed in a pyramid shape to improve outer appearance of the canopy and endure an outside force. To reinforce a corner formed to face the center of the roof, a corner reinforcement bar capable of being hinge coupled between the roof end connection block and the upper head connection block.

Also, a ventilation hole is formed at a sharp center of the roof cloth. The upper head connection block protrudes upward by penetrating the ventilation hole. A double stepped sunshield roof where hinge type sunshield ribs are formed at the upper head connection block separated from the ventilation hole at a predetermined interval can be installed.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1A:
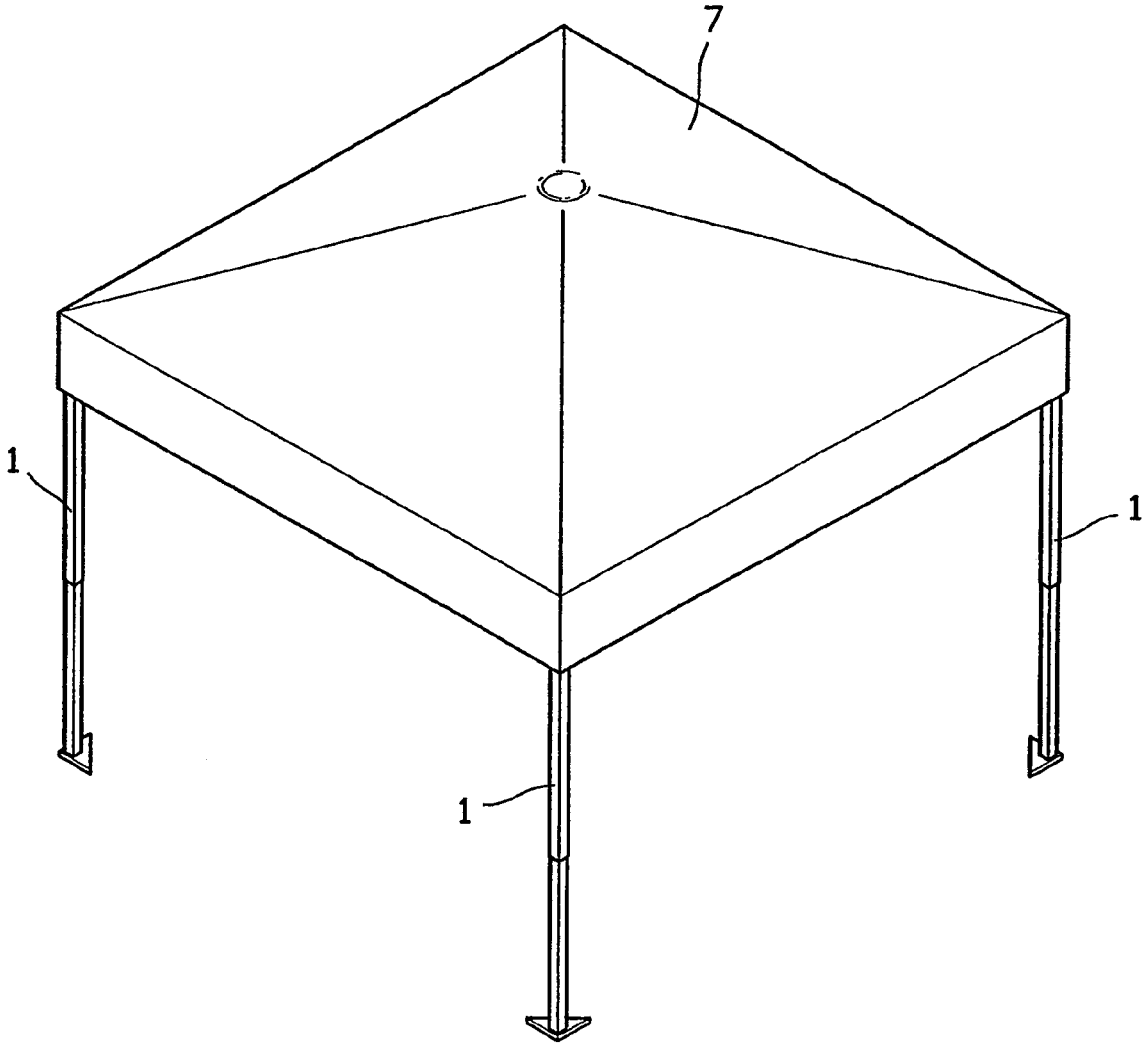
FIGS. 1A and 1B are perspective views illustrating the structure of a single unit canopy of a pyramid type roof according to a preferred embodiment of the present invention.
Figure 1B:
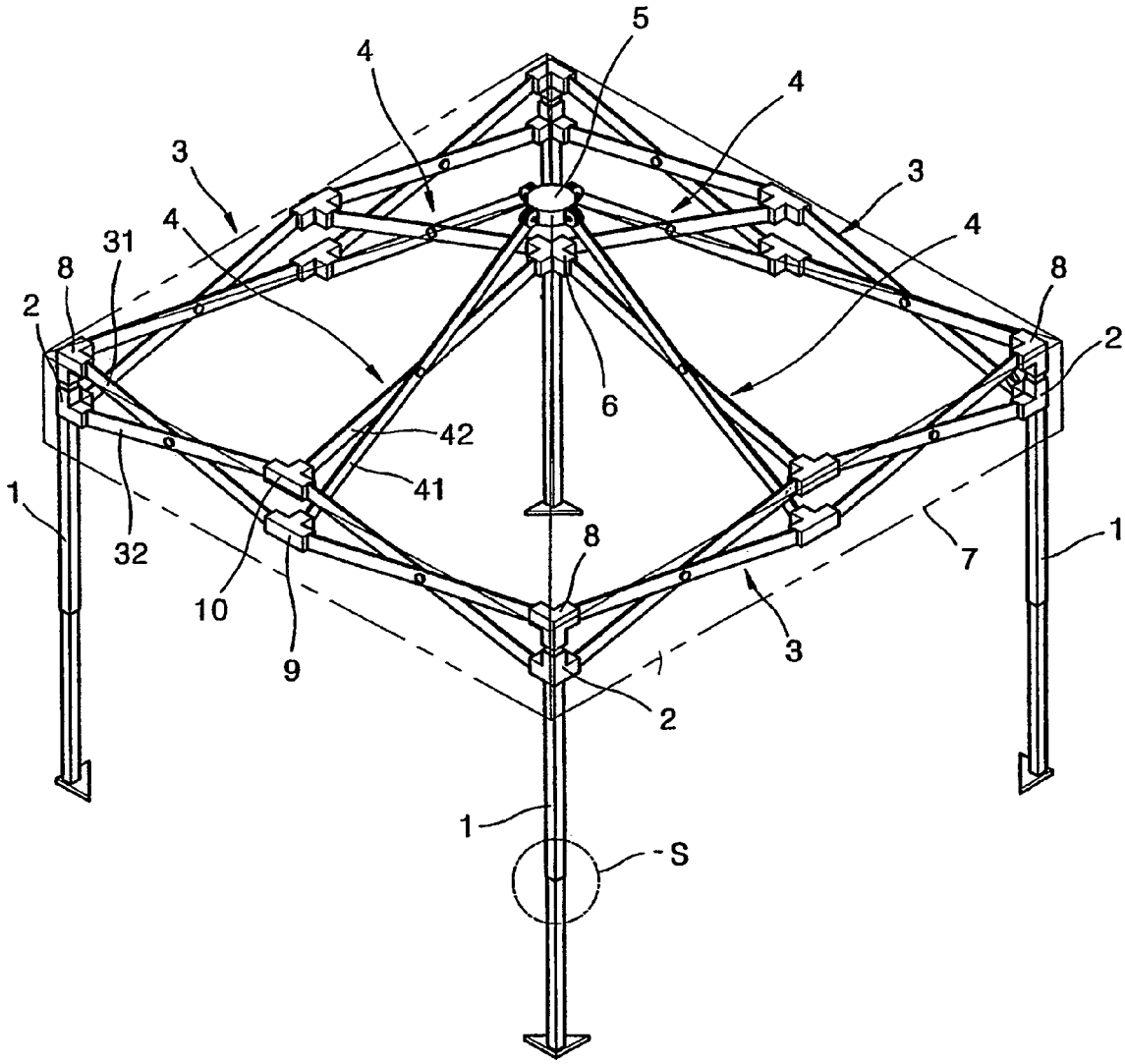

Referring to FIGS. 1A and 1B, the structure of a canopy according to a preferred embodiment of the present invention includes a pillar 1, a slide connection block 2, an end portion connection block 8, a roof edge frame 3, a roof center frame 4, a rod connection block 10, an upper head connection block 5, a lower head connection block 6, and a roof cloth 7.

Figure 2A:
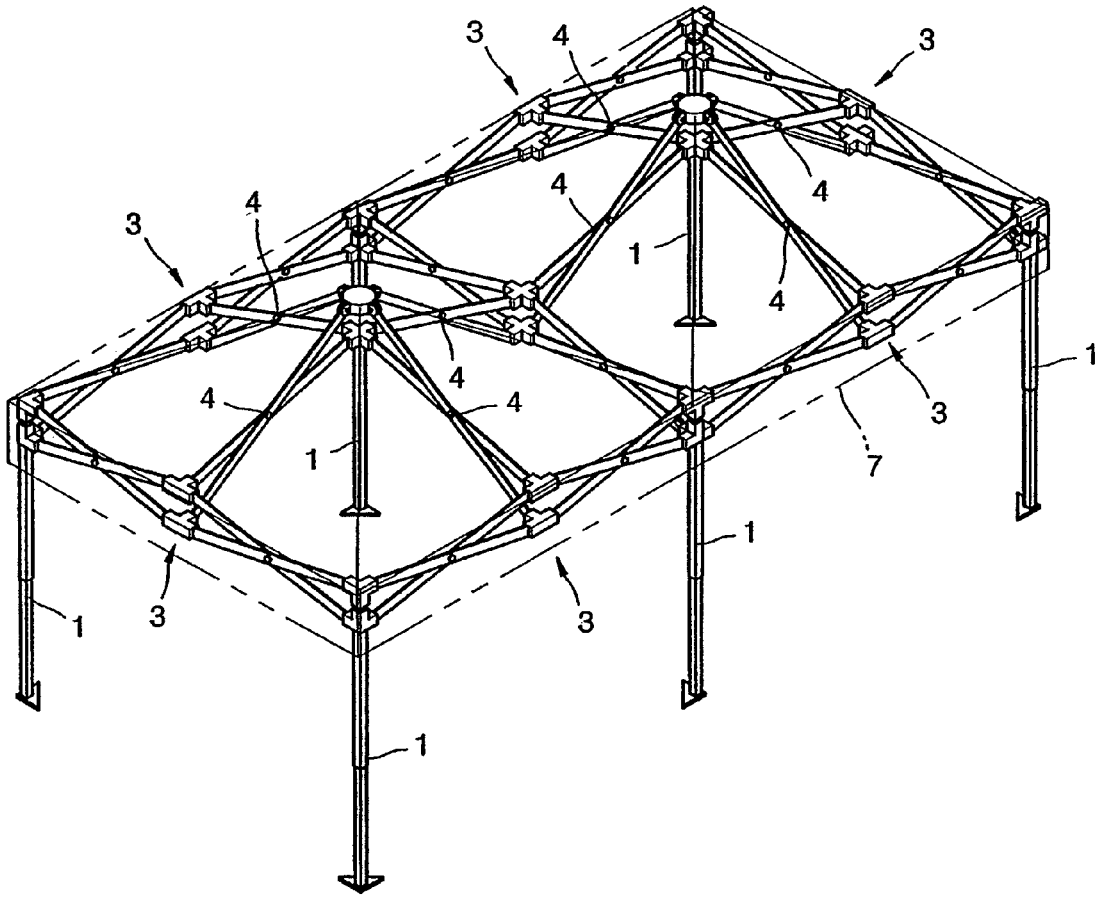
FIG. 2A is a perspective view illustrating the structure of a double unit canopy according to another preferred embodiment of the present invention.

The pillar 1 is erected from the ground to support the canopy of the present invention. The pillar 1 is vertically erected in a multiple number to support a roof such that four pillars are installed for a single unit canopy as shown in FIG. 1B, minimum six pillars are installed for a double unit canopy as shown in FIG. 2A, and minimum eight pillars are installed for a three-unit canopy. Also, as shown in FIGS. 2B and 2C, for a four-unit canopy arranged in a square form, peripheral pillars are installed so that a total of eight pillars are installed while a center pillar is removed.

Figure 2B:
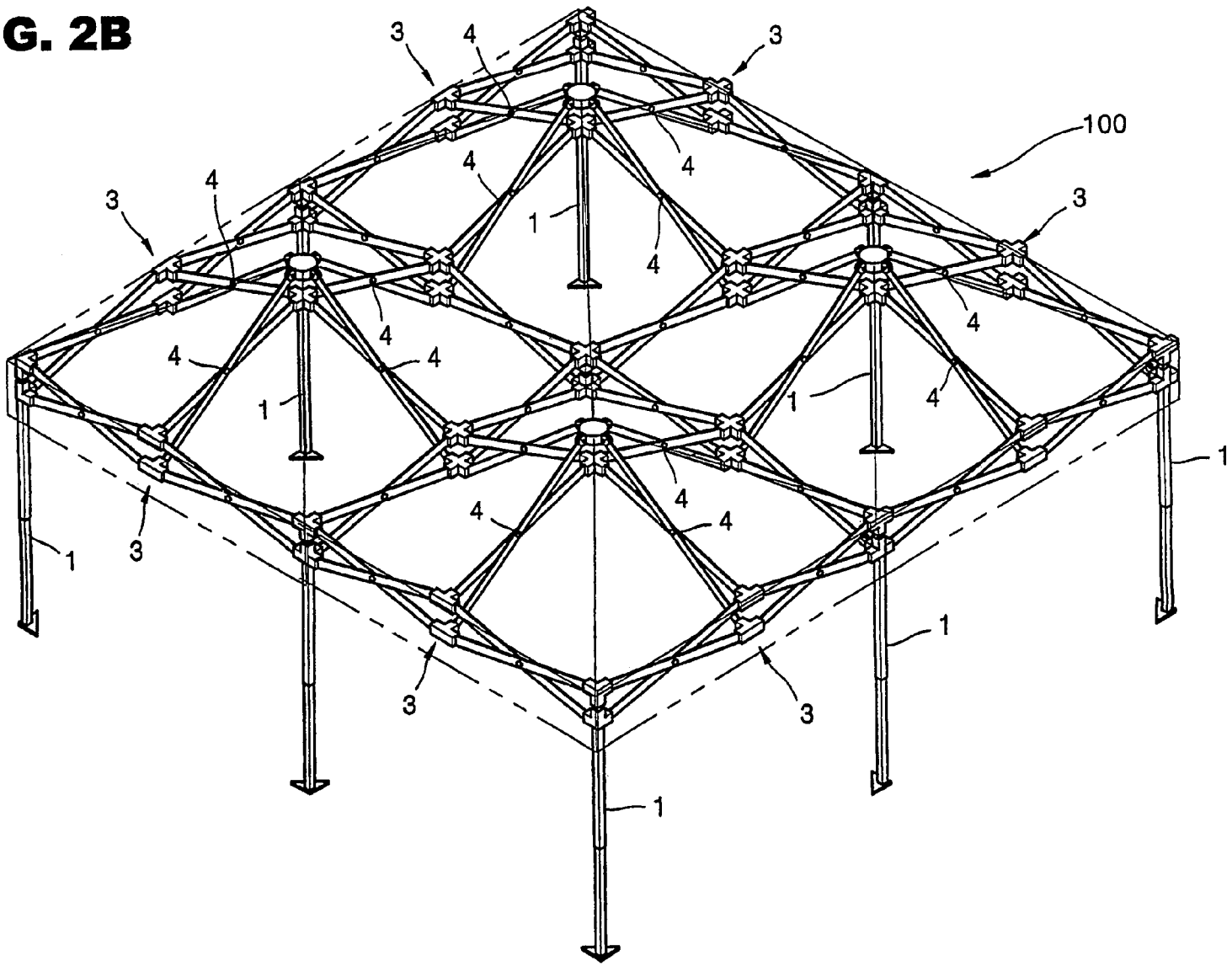
FIG. 2B is a perspective view illustrating the structure of a multiunit canopy according to yet another preferred embodiment of the present invention.
Figure 2C:
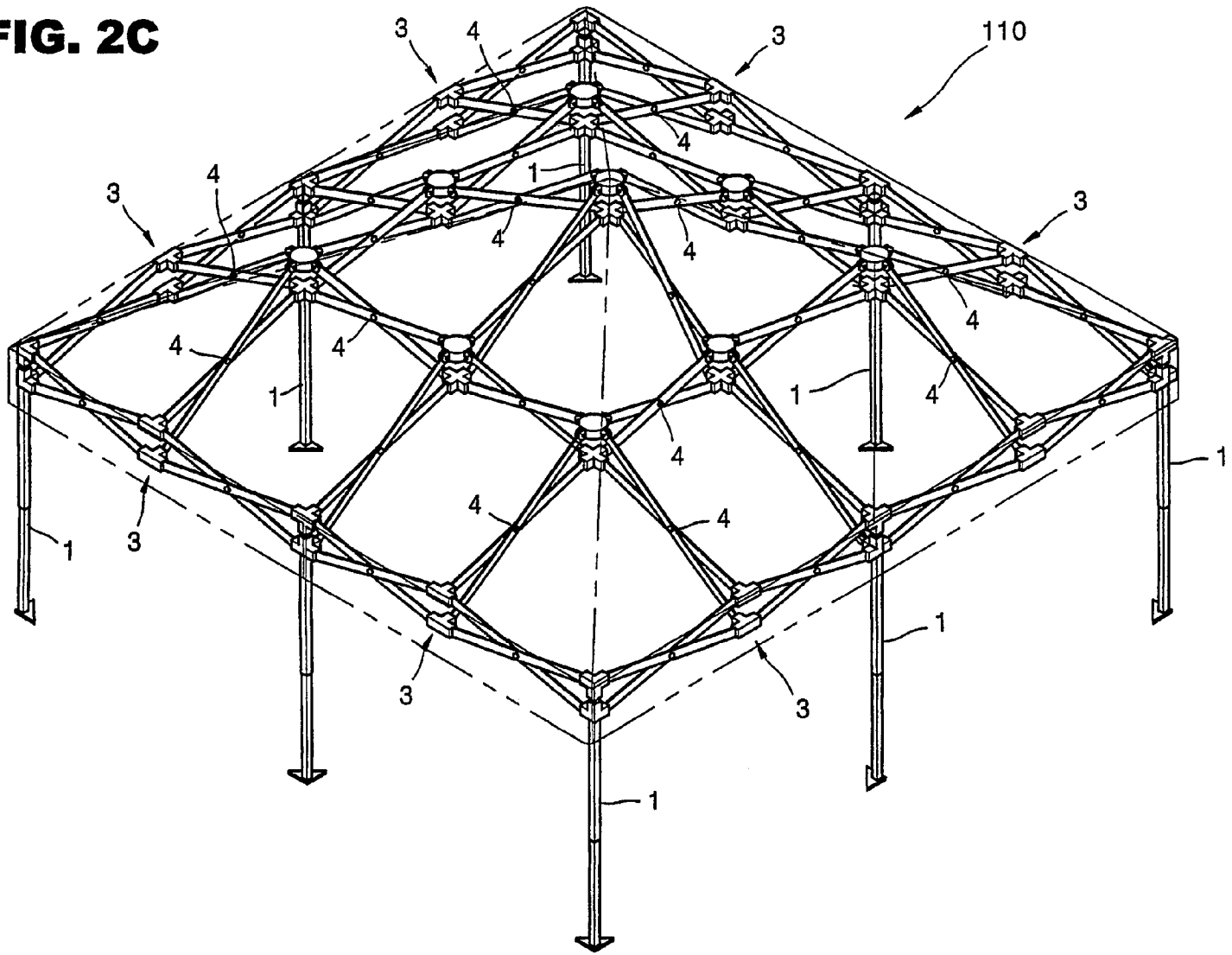
FIG. 2C is a perspective view illustrating the structure of a multiunit canopy according to yet further another preferred embodiment of the present invention.

As shown in FIGS. 2B and 2C, the multiunit canopy where the center pillar is removed may be a single-roof multiunit canopy having a single roof 100 where four pointed small roofs are formed, as shown in FIG. 2B, or a double-roof multiunit canopy having a double roof 110 where roofs are formed double to constitute a single pointed large center roof, as shown in FIG. 2C.

The slide connection block 2 is formed to encompass the pillar 1 and capable of sliding up and down along the pillar 1. When the roof is unfolded, the slide connection block 2 slides up to a raised position and is not lowered by being hooked by a key lever included in the slide connection block 2.

When the roof is hinge folded, a user releases the key lever by pressing it so that the slide connection block 2 is freely lowered. Then the user gathers the pillars to hinge fold the roof edge frame 3 and the roof center frame 4.

Also, the roof edge frame 3 supporting the edge of the roof includes a first rod 31 and a second rod 32. The first rod 31 pivots around the end portion connection block 8 of the pillar 1 and the second rod 32 pivots around the side connection block 2, so that the center portion thereof pivots in X form and capable of being hinge folded. At least two pairs of the roof edge frame 3 are connected for one side of the roof and a plurality of the roof edge frames are formed (eight pairs in the drawing).

The roof center frame 4 supporting the center portion of the roof includes four pairs of a first rod 41 and a second rod 42. The first rod 41 pivots around a rod connection block 9 of the first rod 31 of the roof edge frame 3. The second rod 42 pivots around the rod connection block 10 of the second rod 32 of the roof edge frame 3. Thus, the center portion of the first and second rods 41 and 42 pivots in X form and capable of being hinge folded.

When the roofs are unfolded, to make the height of the upper head connection block 5 higher than that of the roof edge frame 3, the rod of the roof center frame 4 is longer than the roof edge frame 3 and the first rod 41 of the roof center frame 4 is longer than the second rod 42, so that a roof top can be formed with no additional vertical rod at the center of the roof.

The upper head connection block 5 pivots around the first rod 41 of each of a plurality of the roof center frames 4, thus forming the outer top end of the roof. The lower head connection block 6 pivots around the second rod 42 of each of the four roof center frame 4, thus forming the inner top end of the roof.

The roof cloth 7 forms a sunshield cover covering the roof edge frame 3 and the roof center frame 4, which can drain rainwater during raining.

Thus, as shown in FIG. 1B, when the user widens a space between four pillars 1, the slide connection block 2 is raised. Also, an angle between the first and second rods 31 and 32 of the roof edge frame 3 narrows and the length thereof extends. Simultaneously, an angle between the first and second rods 41 and 42 of the roof center frame 4 connected to the roof edge frame 3 narrows and the length thereof extends. Since the first rod 41 of the roof center frame 4 is longer than the second rod 42 thereof, the upper head connection block 5 is raised higher than the roof edge frame 3.

Next, when the user widens a space between the pillar 1 at its maximum, the slide connection block 2 is not lowered by being hooked by the key lever. Accordingly, the roof edge frame 3 and the roof center frame 4 are fixed. When the user covers the roof cloth 7 over the roof edge frame 3 and the roof center frame 4, as shown in FIG. 1A, the canopy according to the present invention can be completed.

Then, when the user releases the key lever by pressing it to lower the slide connection block 2, the pillar 1 is closed to completely hinge fold the roof edge frame 3 and the roof center frame 4so that volume is minimize and the canopy is easily kept and carried.

Figure 2D:
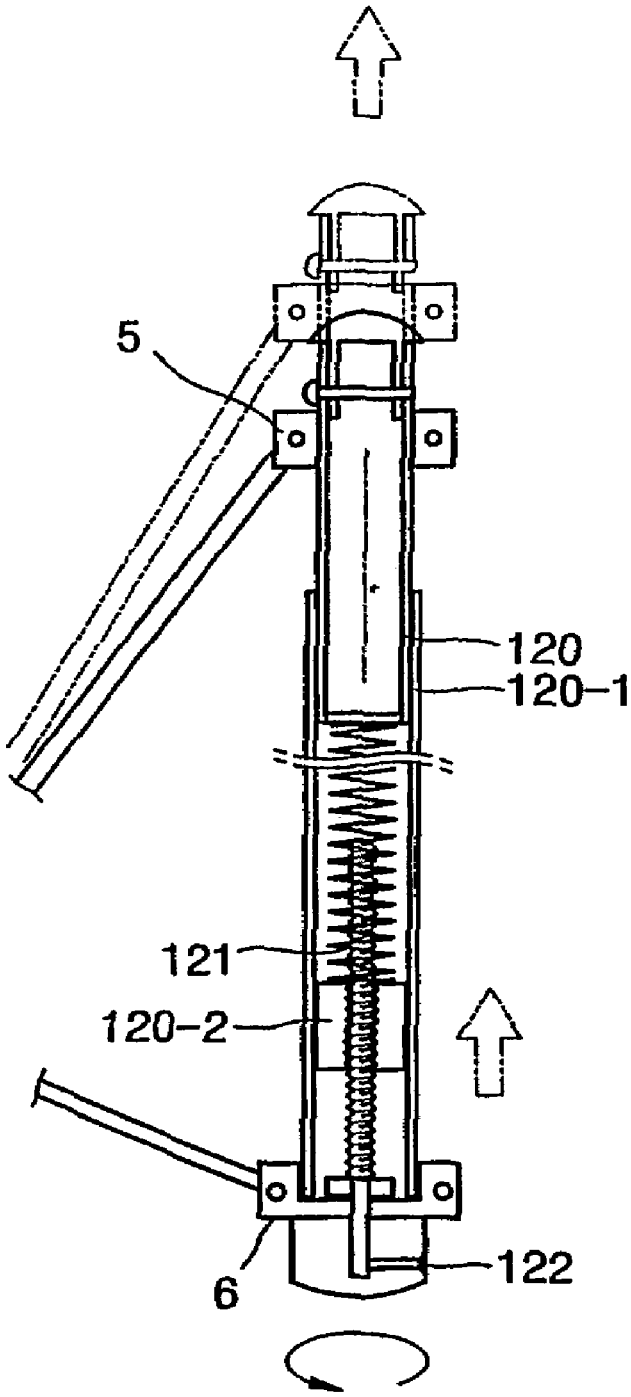
FIG. 2D is a view illustrating an example of an upper roof pillar of which height can be adjusted adopted in the present invention.

In the meantime, as shown in FIG. 2D, an upper roof column 120 penetrating the upper head connection block 5 and capable of sliding with respect to the upper head connection block 5 is installed on the lower head connection block 6. An elastic spring 121 is installed under the upper roof column 120 and inside a lower roof column 120-1 to be capable of adjusting height of the upper roof column 120. To adjust displacement of the elastic spring 121, a rotary handle 122 can be rotatably installed at the lower head connection block 6, so that one end of the rotary handle 122 penetrates the elastic spring 121 and is fixed to an end portion of the elastic spring capable of freely rotating and, when the other end thereof rotates, a nut 120-2 screw reciprocates with respect to the lower head connection block 6. However, as shown in FIG. 1B, the upper roof column 120 can be omitted.

Figure 2E:
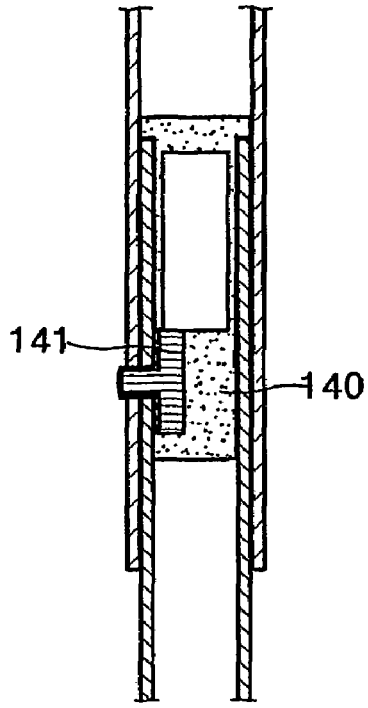
FIG. 2E is a sectional view illustrating an example of a round strap type snap button of a circular pipe adopted in the present invention.
Figure 2F:
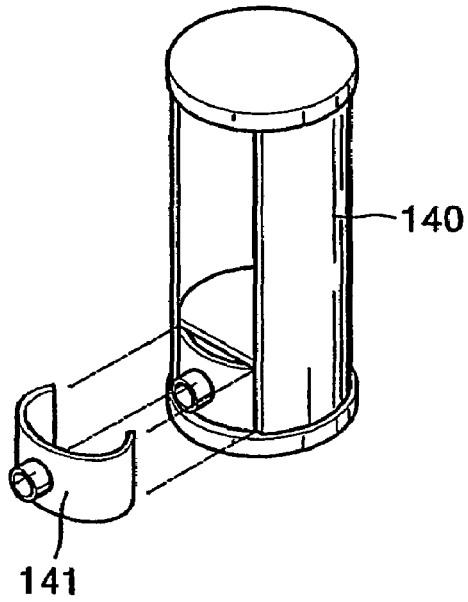
FIG. 2F is a perspective view of the circular pipe of FIG. 2E.
Figure 2G:
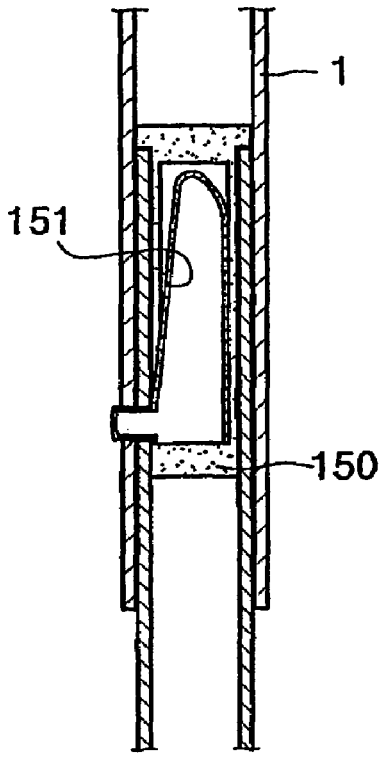
FIG. 2G is a sectional view illustrating an example of a snap button of a rectangular pipe adopted in the present invention.
Figure 2H:
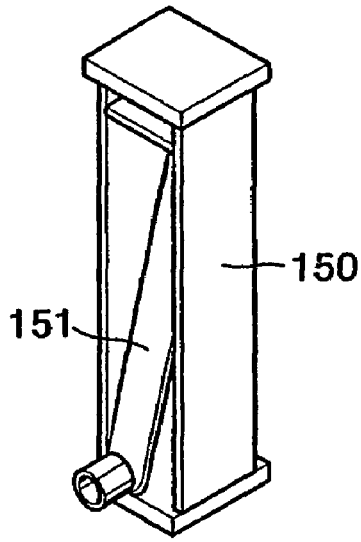
FIG. 2H is a perspective view of the rectangular pipe of FIG. 2G.
Figure 2I:
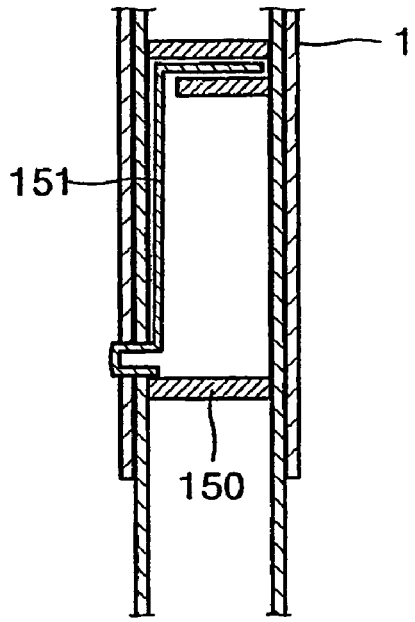
FIG. 2I is a sectional view illustrating another example of the snap button of a rectangular pipe adopted in the present invention.
Figure 2J:
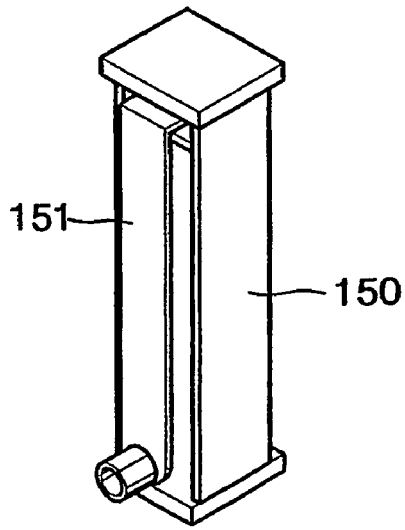
FIG. 2J is a perspective view of the rectangular pipe of FIG. 2I.
Figure 2K:
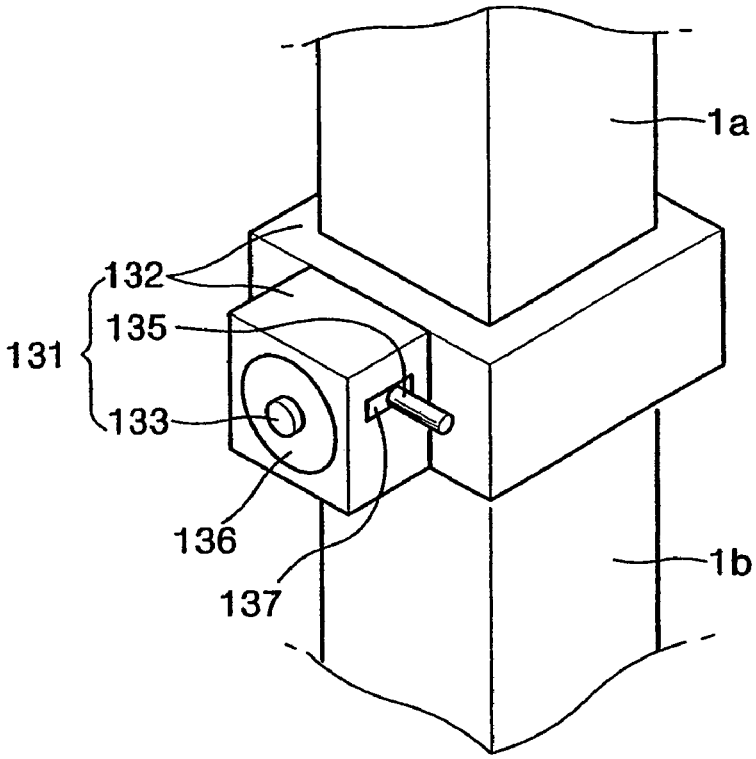
FIG. 2K is a perspective view illustrating a fixed block adopted in a pillar of the present invention.
Figure 2L:
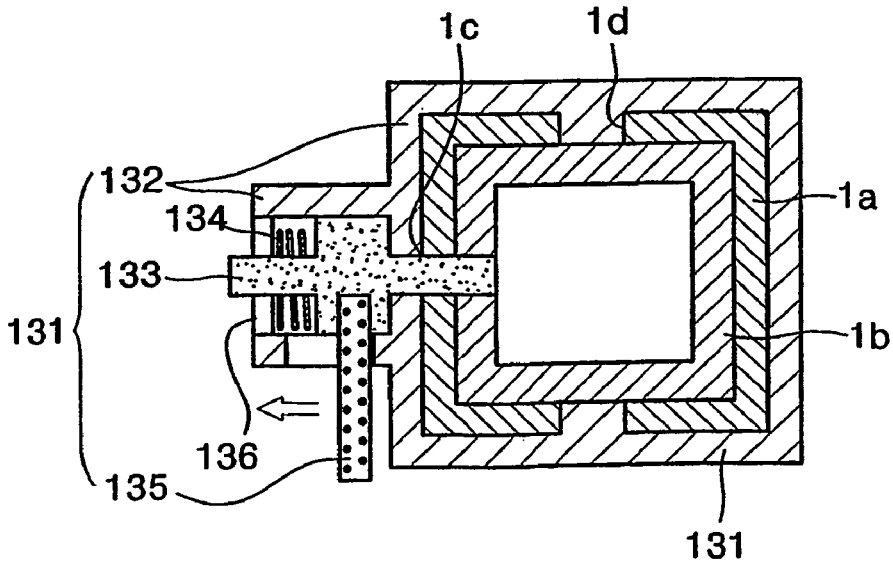
FIG. 2L is a sectional view illustrating the fixed block of FIG. 2K.

As shown in FIGS. 2K and 2L, an S portion of the pillar 1 includes an inner pipe 1*b* inserted in an outer pipe 1*a* capable of sliding therein to adjust the height of the pillar 1. A key lever 133 elastically hooked in a through hole 1*c* formed in the outer pipe 1*a* is installed at the inner pipe 1*b*. A fixing block 131 fixing the inner and outer pipes 1*b* and 1*a* is installed at the outer pipe 1*a*.

The key lever 133 may be a circular pipe snap button applied to the pillar 1 having a circular pipe shape according to use thereof, in which a spring 141 having a round strap shape is installed at a circular column type inner frame 140, as shown in FIGS. 2E and 2F, or a rectangular pipe snap button applied to the pillar 1 having a rectangular pipe shape, in which a trigger type spring 151 (a U shape shown in FIGS. 2G and 2H and an L shape shown in FIGS. 2I and 2J) installed at a rectangular column type inner frame 150, as shown in FIGS. 2G, 2H, 2I, and 2J.

The round strap spring 141 shown in FIG. 2F is not necessary for the inner frame 140. The spring 141 can be solely installed without the inner frame 140 at an installation position which is relatively shallow from the end portion of the pillar.

To prevent damage to a hand of a user, as shown in FIGS. 2K and 2L, the fixing block 131 includes a main body 132, the slide type key lever 133, an elastic spring 134, and a key lever handle 135. The main body 131 is an injection molding block where a rail is formed. The slide type key lever 133 slides on the rail in the main body 131. The slide key lever 133 is a column type injection block of which a leading end portion penetrates the inner pipe 1*b* of the column 1 and is fixed there when the slide key lever 133 slides forward. The elastic spring 134 is inserted around a tailing end portion of the slide type key lever 133 and installed between a fixing cap 136 and the slide type key lever 133, so that a restoration force is applied in a direction to advance the slide type key lever 133.

The key lever handle 135 is a handle having one end screw coupled or coupled to a screw hole formed in one side of the slide key lever 133 and the other end protruding from a slide hole 137 formed in one side of the main body 132. A user moves the slide type key lever 133 backward so as to make the inner pipe 1*b* free.

Thus, the canopy is kept by inserting the inner pipe 1*b* into the outer pipe 1*a* of the pillar 1. When the canopy is to be used, the user pulls the inner pipe 1*b* and then the inner pipe 1*b* and the outer pipe 1*a* are automatically fixed by a key lever 133 penetrating the through hole due to the restoration force. To keep and disassemble the canopy, the user holing the key lever handle 135 moves the slide type key lever 133 backward so that the inner pipe 1*b* is made free to be inserted.

Figure 3A:
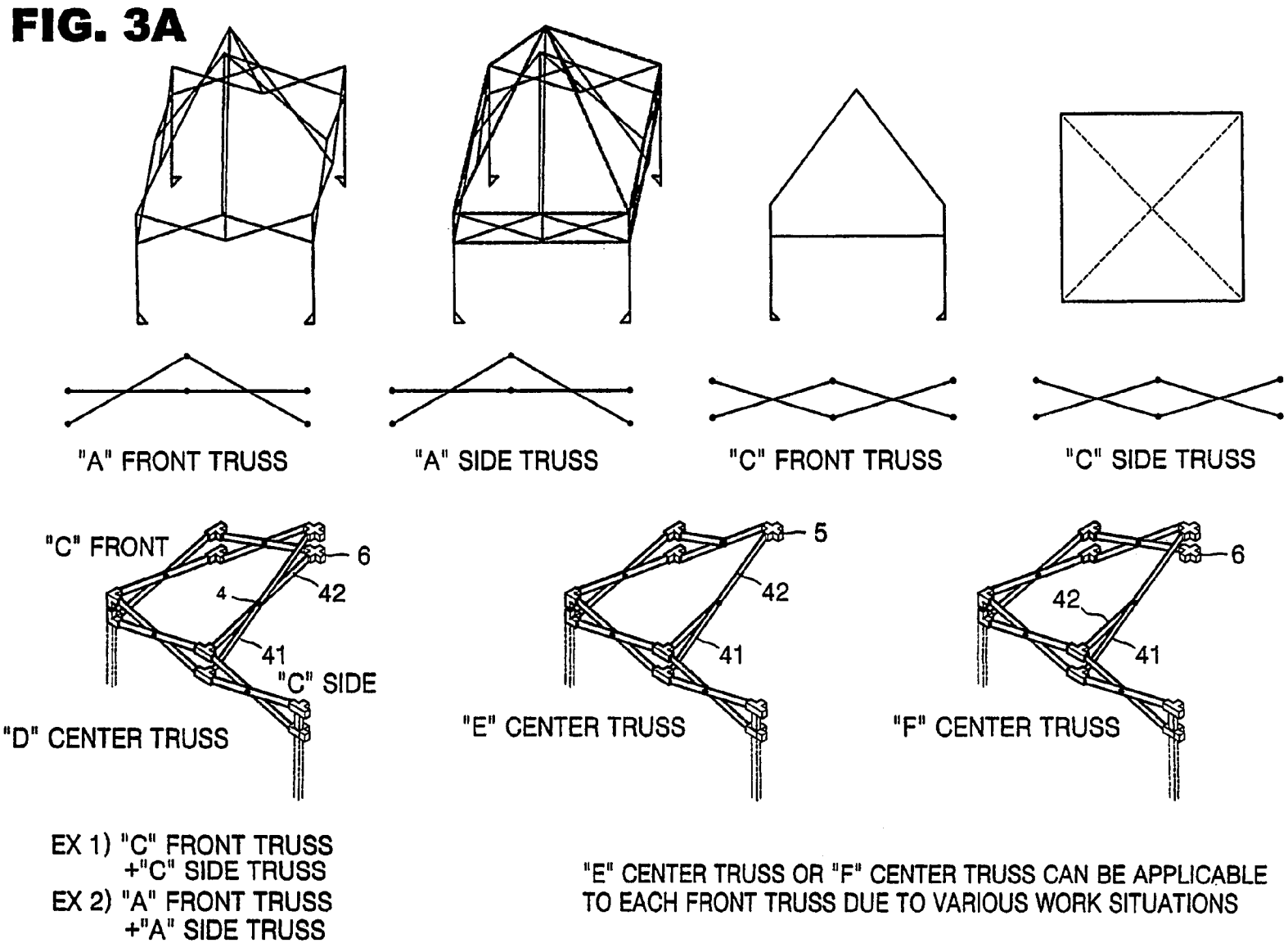
FIGS. 3A, 3B, 3C, 3D, and 3E are views illustrating the shapes of a canopy adopting the structure of the canopy according to the present invention and modified examples thereof.
Figure 3B:
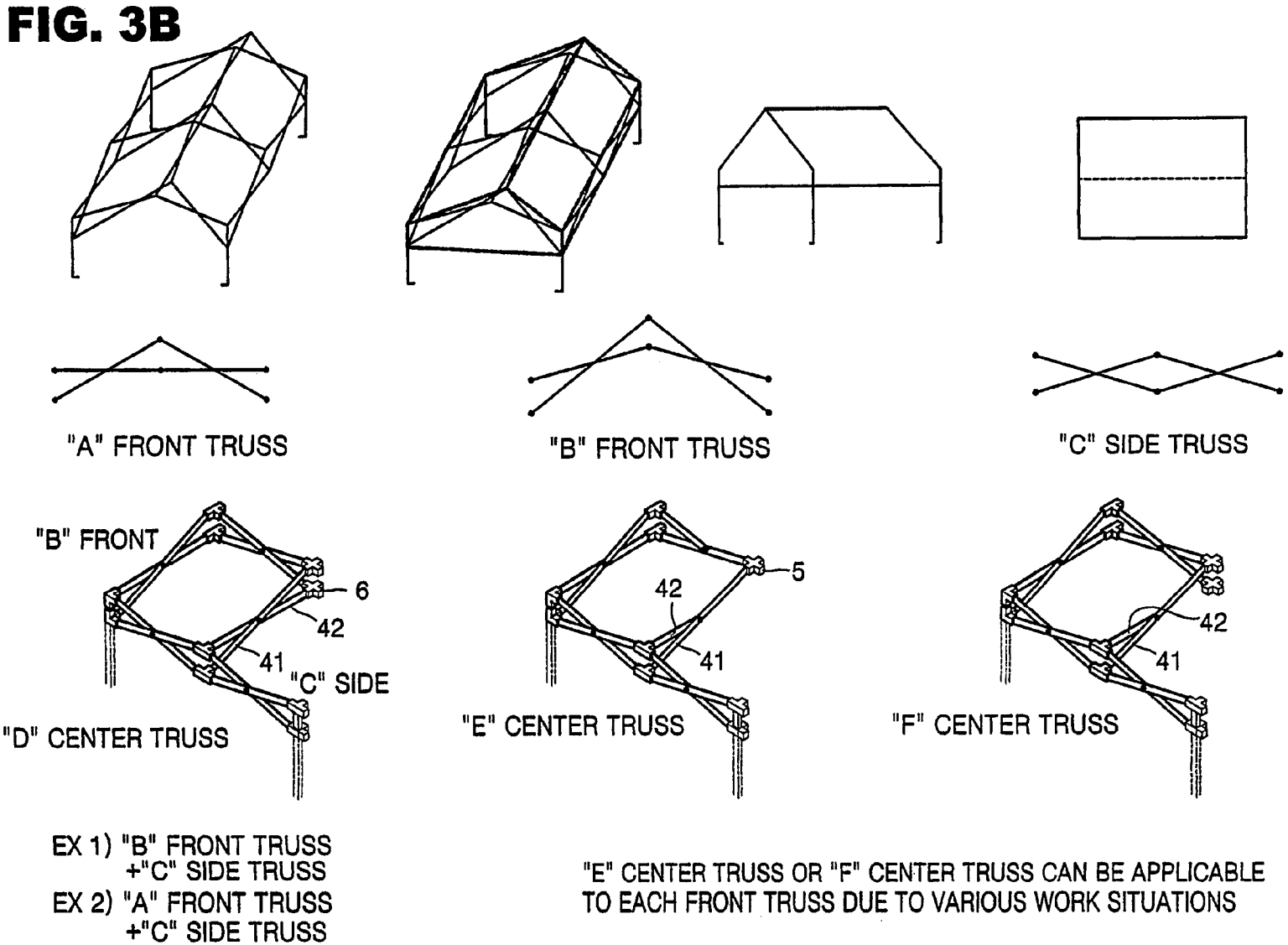
Figure 3C:
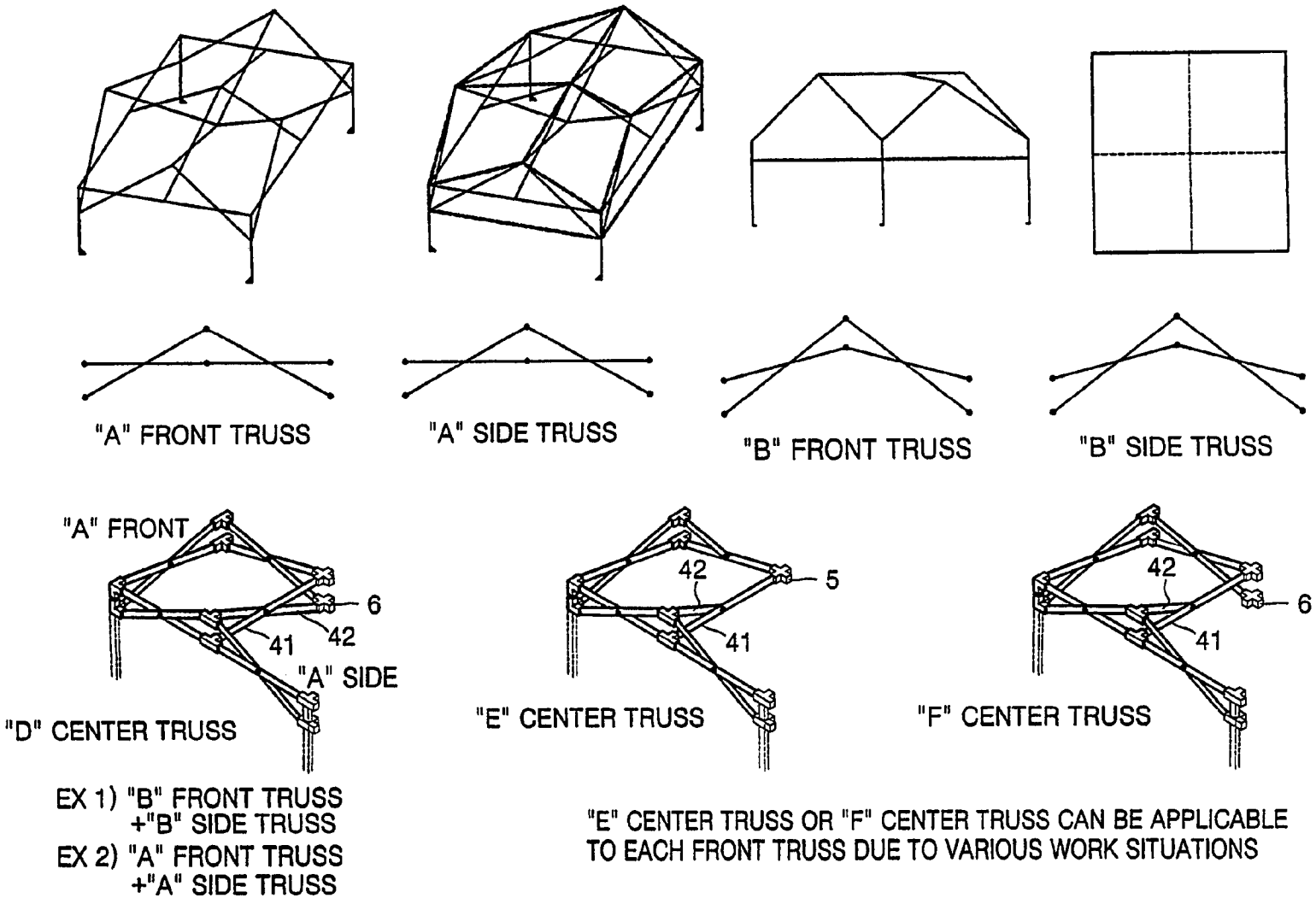
Figure 3D:
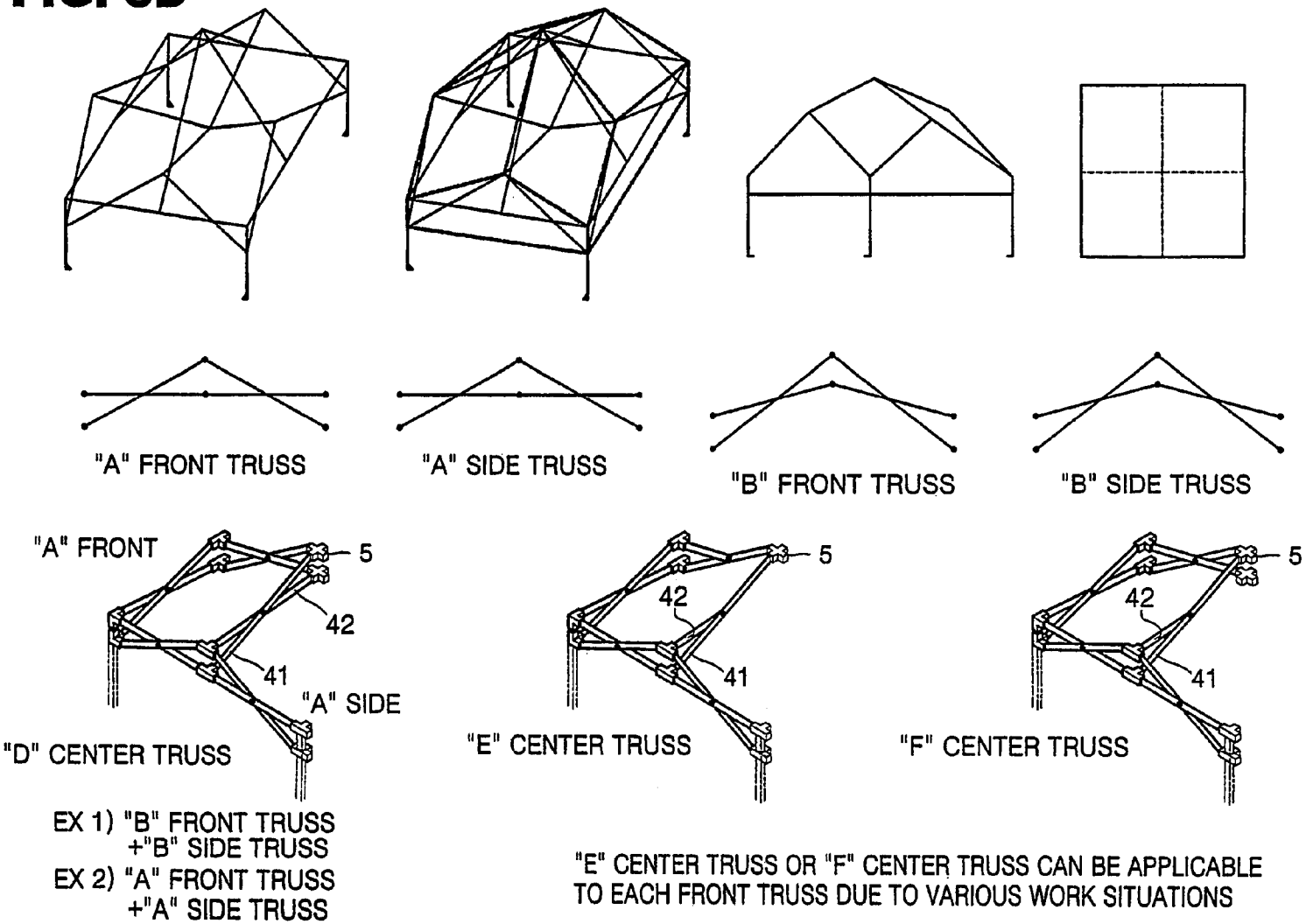
Figure 3E:
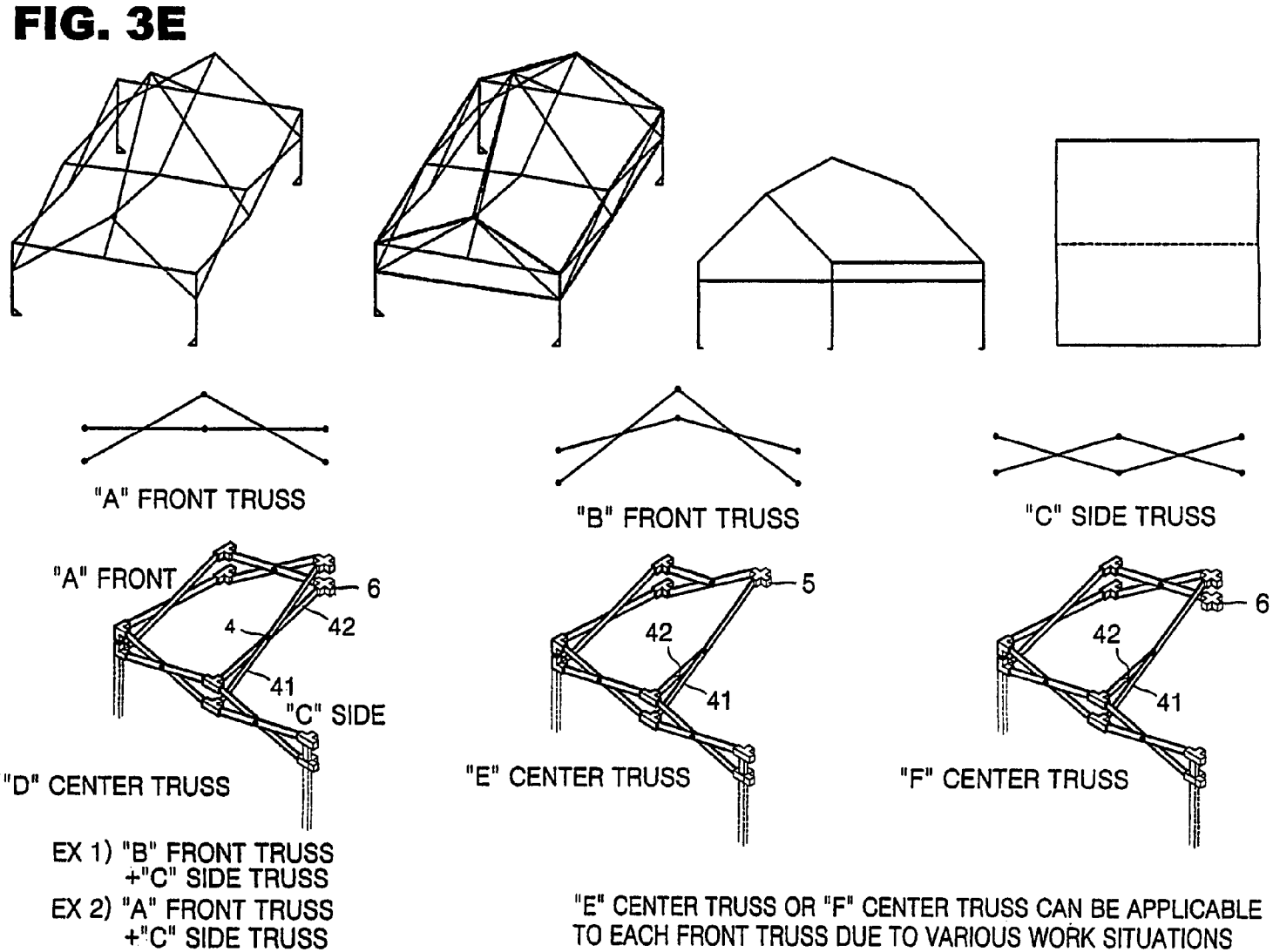

In the meantime, as shown in FIGS. 3A. 3B, 3C, 3D, and 3E, the structure of the canopy according to the present invention is not limited to a pyramid type roof adopting an "A" front truss shown in FIGS. 1A, 3A, and 3B, but a slate roof shown in FIG. 3B, a cross type roof shown in FIG. 3C, a cross-pyramid type roof shown in FIG. 3D, and a modified cross-pyramid type roof shown in FIG. 3E. Each of the center portions can be applied by modifying the center portions shown in FIGS. 7A, 7B, and 7C. To reinforce truss, a wire or a steel bar can be connected to around the upper end head block.

The slate roof of FIG. 3B is designed such that the rods of the high roof center frame at the center peak of FIG. 1B are assembled such that the front side surface and the rear side surface identically cross. The shape of the peak can vary by designing the vertical length and horizontal length of the roof edge frame the same or different from each other (in which "A" and "B" front truss can be applied).

The cross roof of FIG. 3C can be designed by exchanging and assembling the rods of the roof center frame at the left and right side surfaces in FIG. 3B. Thus, rain or snow can flow down toward the four corners from the central peak (in which "B" front truss of FIG. 3B can be applied).

The cross-pyramid roof of FIG. 3D can be designed by making the central peak, that is, the pipe of the roof center frame, quite high. Thus, the canopy can be used in an area having much snow or rain, (in which "B" front truss of FIG. 3B can be applied).

The modified cross-pyramid roof of FIG. 3E can be designed by removing the peak portion at the left and right side surfaces of FIG. 3D so as to maintain the height of the middle portion at the front and rear sides (in which "B" front truss of FIG. 3B can be applied).

In FIGS. 3A-3E, in each of the roof edge frames in the "A" front truss, the "A" side truss, the "B" front truss, and the "B" side truss, the second rod is longer than the first rod.

In addition to the above examples, the structure of the canopy of the present invention can be applied to all canopies having a variety of shapes and types.

Also, in addition to the canopies shown in FIGS. 3A, 3B, 3C, 3D, and 3E, by installing two more pillars 1 and installing the roof edge frame 3 and the roof center frame 4 to be extended, two pairs of the upper head connection blocks 5 and the lower head connection block 6 are formed in two roof form.

In addition, as necessary, the pillar 1, the roof edge frame 3, and the roof center frame 4 can be further extended to form multiple units such as three units or four units.

Figure 5A:
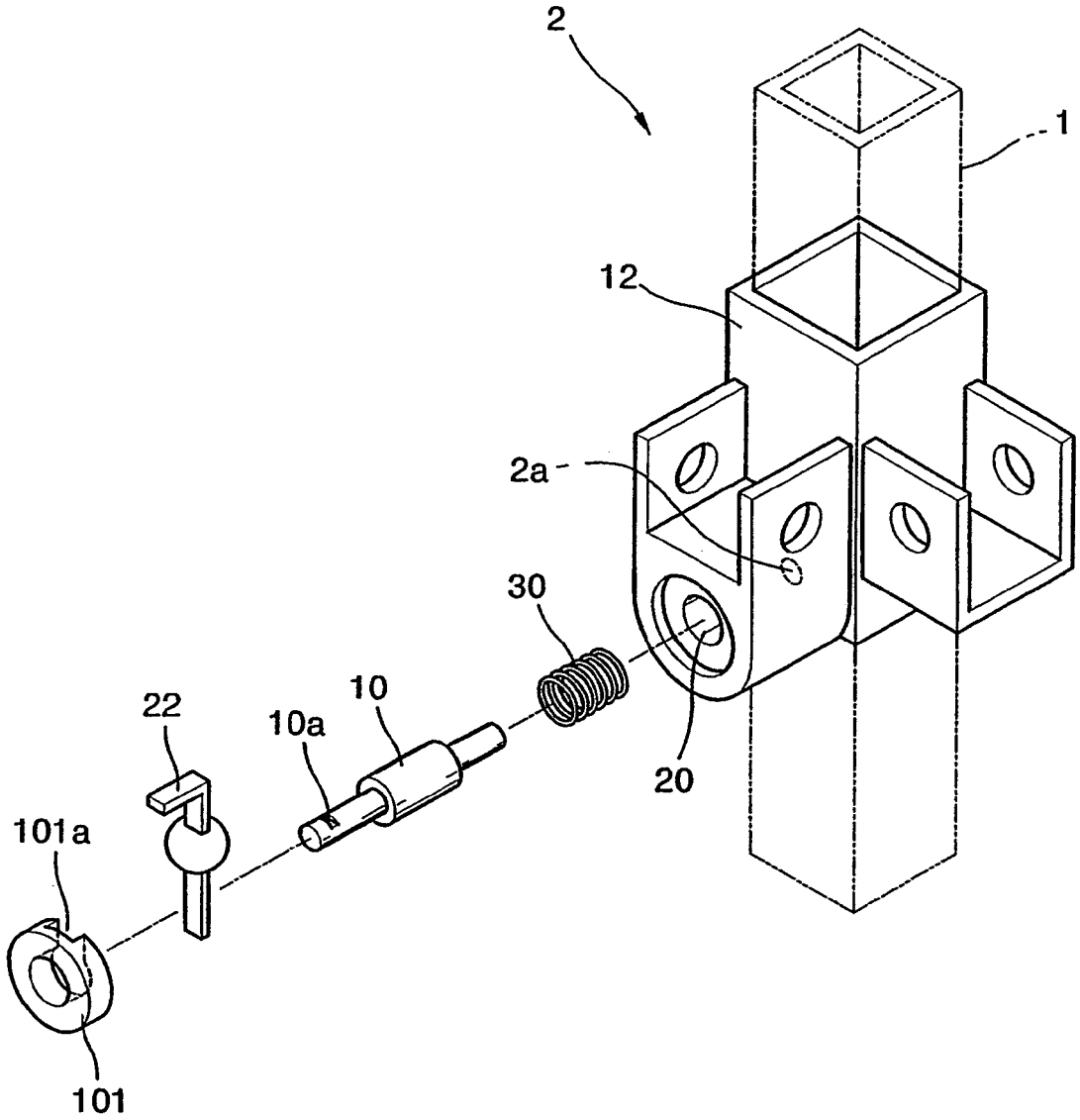
FIG. 5A is an exploded perspective view illustrating a preferred embodiment of a key lever of a slide connection block of FIG. 1B.

As shown in FIG. 5A, the slide connection block 2 operated by indirectly pressing a slide key lever 101 to prevent a damage to a finger of a user includes a main body 12, the slide key lever 101, an elastic spring 30, and a key lever fixing tool 22.

That is, the main body 12 is an injection molding block where a cylindrical rail 20 is formed in a lower portion thereof. The slide key lever 101 is a column type injection block which is inserted in the rail 20 of the main body 12 capable of sliding. When the user presses the slide key lever 101 and slidingly advances the same, a leading end portion of the slide key lever 10 is inserted in a through hole 2*a* formed in the pillar 1.

Also, the elastic spring 30 is inserted around the leading end portion of the slide key lever 101 and installed between the main body 12 and the slide key lever 101. The elastic spring 30 generates a restoration force in a direction in which the slide key lever 101 is retreated.

The key lever fixing tool 22 is a latch caught by a hook groove 10*a* formed in the slide key lever 101. The key lever fixing tool 22 is a kind of stopper which is inserted in a vertical hole 101*a* formed in a fixing cap 101 covering and fixing the slide key lever 101 and descends by the weight thereof. The leading end portion of the key lever fixing tool 22 is caught by the hook groove 10*a* of the slide key lever 101 so that the key lever fixing tool 22 locks the slide key lever 101 in an advanced state.

Thus, when the user is to descend the slide connection block 2 hooked by the slide key lever 101, the key lever fixing tool 22 locking the side key lever 10 is lifted to make the slide key lever 101 move freely. As the slide key lever 101 retreats by the elastic spring 30, the leading end portion of the slide key lever 101 is separated from the through hole 2*a* formed in the pillar 1. Then, the pillar 1 is separated from the slide connection block 2 so that the slide connection block 2 can freely descend.

When the slide connection block 2 is to be fixed to the pillar 1, the user pushes the rear end portion of the slide key lever 101 to insert the leading end portion of the slide key lever 101 into the through hole 2*a* of the pillar 1 so that the slide connection block 2 is fixed to the pillar 1. Then, to prevent retreat of the slide key lever 101, the key lever fixing tool 22 is naturally lowered by the weight thereof in the vertical hole 101*a* of the fixing cap 101 so as to be fixedly inserted.

Figure 5B:
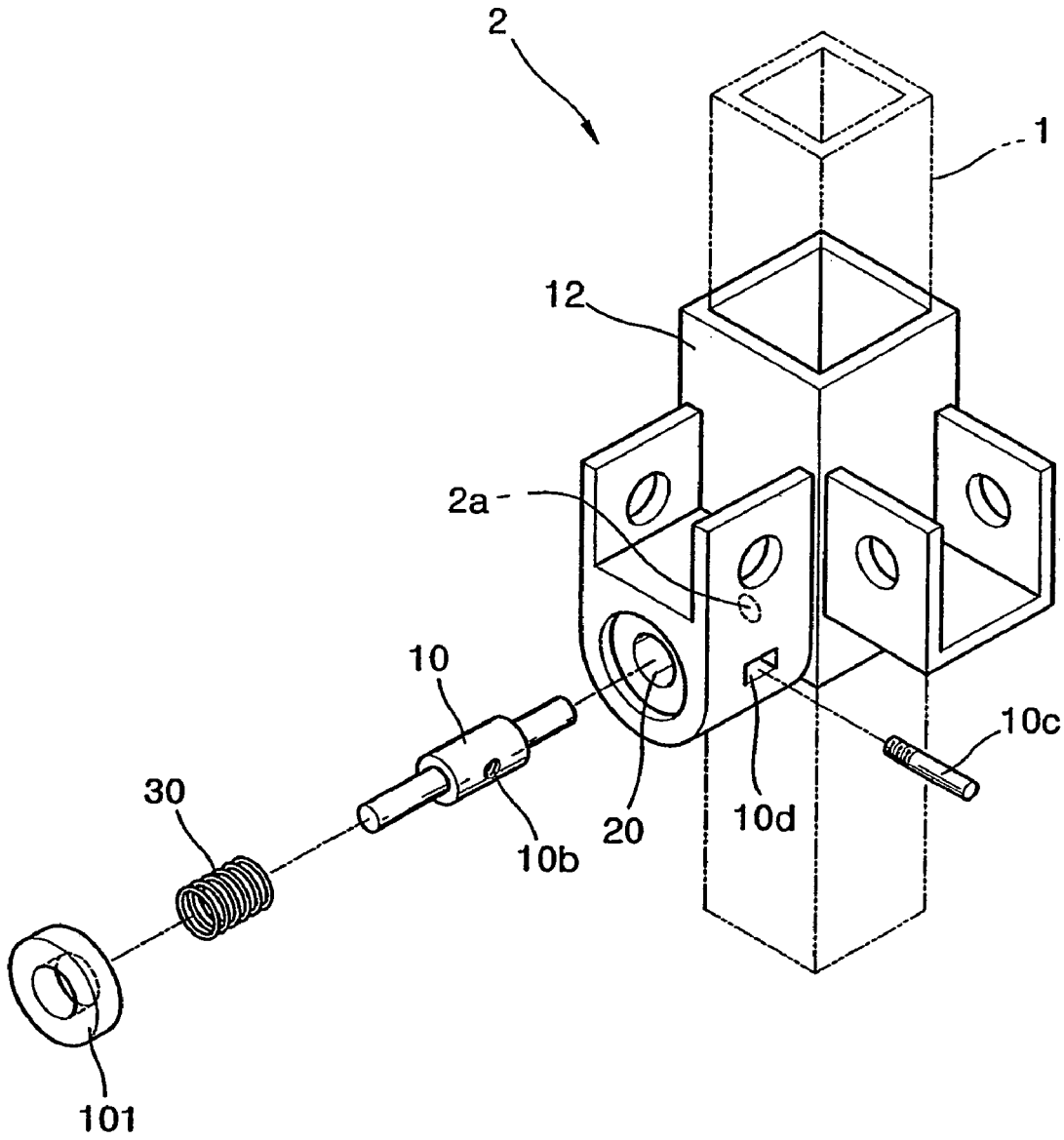
FIG. 5B is an exploded perspective view illustrating another preferred embodiment of the key lever of a slide connection block of FIG. 1B.

As shown in FIG. 5B, the slide connection block 2 operated by indirectly pulling a key lever handle 10*c* to prevent a damage to a finger of a user includes the main body 12, the slide key lever 101, the elastic spring 30, and the key lever handle 10*c*.

That is, the main body 12 is an injection molding block where the cylindrical rail 20 is formed in a lower portion thereof. The slide key lever 101 is a column type injection block which is inserted in the rail 20 of the main body 12 capable of sliding. When the slide key lever 101 slidingly advances, a leading end portion of the slide key lever 10 is inserted in the through hole 2*a* formed in the pillar 1.

Also, the elastic spring 30 is inserted around a rear end portion of the slide key lever 101 and installed between the fixing cap 101 and the slide key lever 101. The elastic spring 30 generates a restoration force in a direction in which the slide key lever 101 advances.

The key lever handle 10*c* is a handle having one end screw coupled or fixed to a screw hole 10*b* formed in the side surface of the slide key lever 101 and the other end protruding from a slit 10*d* formed in a side surface of the main body 12. The hinge of the pillar 1 is made free when a user retreats the slide key lever 101 in an advance state.

Thus, in order to descend the slide connection block 2 hooked by the slide key lever 101, the user pulls the key lever handle 10*c* to retreat the slide key lever 101 and the leading end portion of the slide key lever 101 is separated from the through hole 2*a* of the pillar 1. Thus, the locking between the pillar 1 and the slide connection block 2 is released so that the slide connection block 2 can be freely lowered.

Figure 5C:
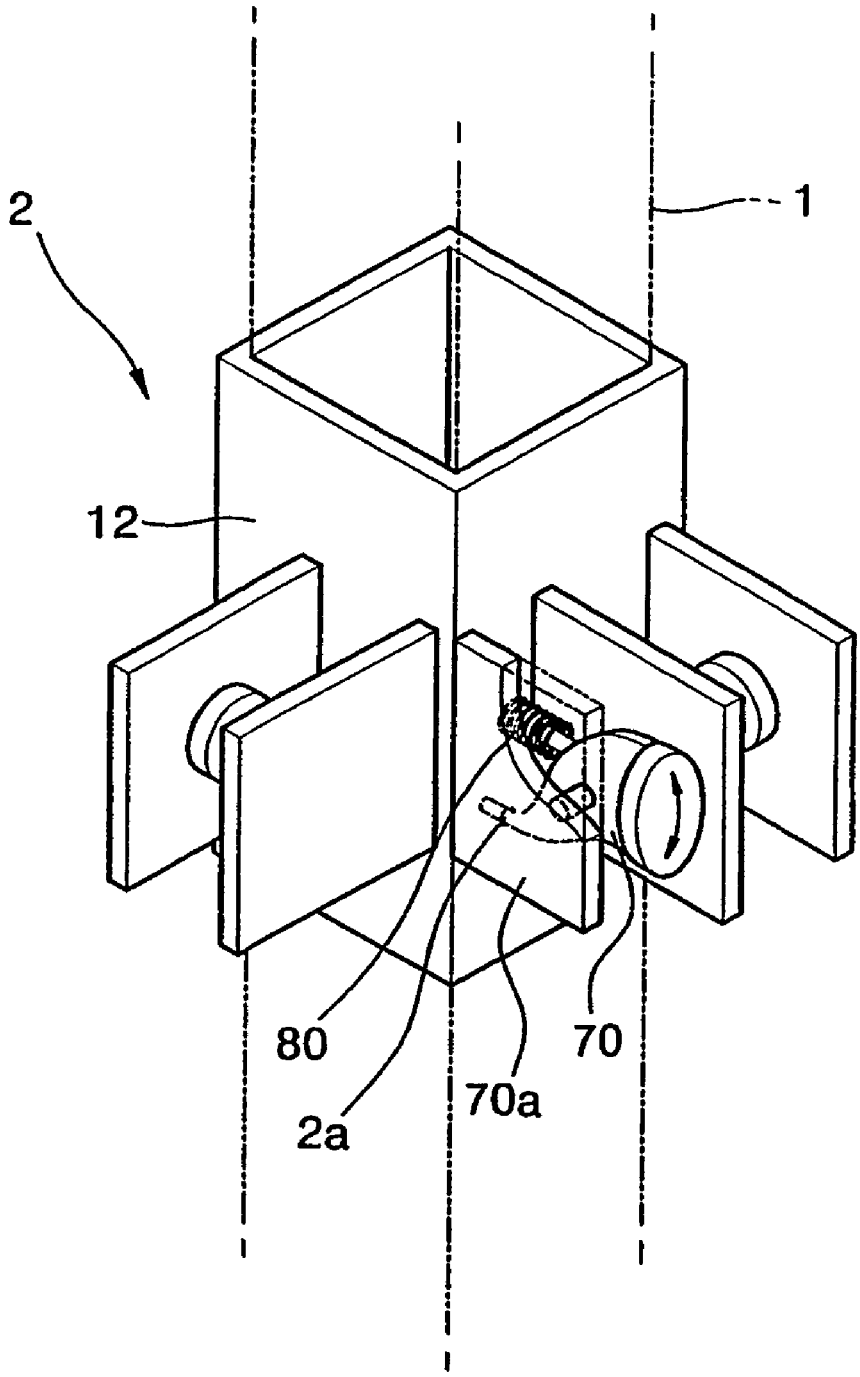
FIG. 5C is a perspective view illustrating yet another preferred embodiment of the key lever of a slide connection block of FIG. 1B.

As shown in FIG. 5C, as another preferred embodiment of a key lever for the slide connection block, the slide connection block 2 has a structure to prevent a damage to a finger of a user by indirectly pressing a rotary key lever 70. The slide connection block 2 includes the main body 12, a rotary key lever 70, and an elastic spring 80.

That is, the main body 12 is an injection molding block where a guide plate 70*a* is formed at one side thereof. The rotary key lever 70 is a rotary plate type injection block which can pivot around a pivot shaft on the guide plate 70*a* of the main body 12. When the user raises the slide connection block 2 to open the canopy, the rotary key lever 70 is rotated by the elastic spring 80 and a tip portion at one side of the rotary key lever 70 is inserted in the through hole 2*a* formed in the pillar 1.

The elastic spring 80 is inserted around the other tip end portion of the rotary key lever 70 and installed between the main body 12 and the rotary key lever 70. The elastic spring 80 generates a restoration force in a direction in which the rotary key lever 70 is rotated.

Thus, in order to lower the slide connection block 2 hooked by the rotary key lever 70, the user presses a handle portion of the rotary key lever 10 to rotate the rotary key lever 10 in the reverse direction. Then, the tip end portion of the rotary key lever 70 is separated from the through hole 2*a* of the pillar 1. Thus, the locking between the pillar 1 and the slide connection block 2 is released so that the slide connection block 2 can be freely descend.

When the slide connection block 2 is to be fixed to the pillar 1, the user simply releases the handle portion of the rotary key lever 70 and the tip end portion of the rotary key lever 70 is pushed by the elastic spring 80 to be inserted in the through hole 2*a* of the pillar 1. Thus, the slide connection block 2 can be fixed to the pillar 1.

In addition to the above exampled, various types of fixing means capable of locking the slide connection block 2 and the pillar 1 can be adopted within a range of the concept of technology of the present invention, which is easily modified or altered by one skilled in the present art.

The slide connection block 2, the end portion connection block 8, the first rod connection block 9, the second rod connection block 10, the upper head connection block 5, and the lower head connection block 6 are plastic injection structures or welding structures according to purposes. Also, according to the shape of the rod, an indented shape having a rectangular, square, circular, or oval shape is possible. If necessary, the block can be manufacture to have an open upper side. A variety of embodiments can be manufacture as shown in FIGS. 4A, 4B, 4C, 4D, 5A, 5B, and 5C.

Figure 4A:
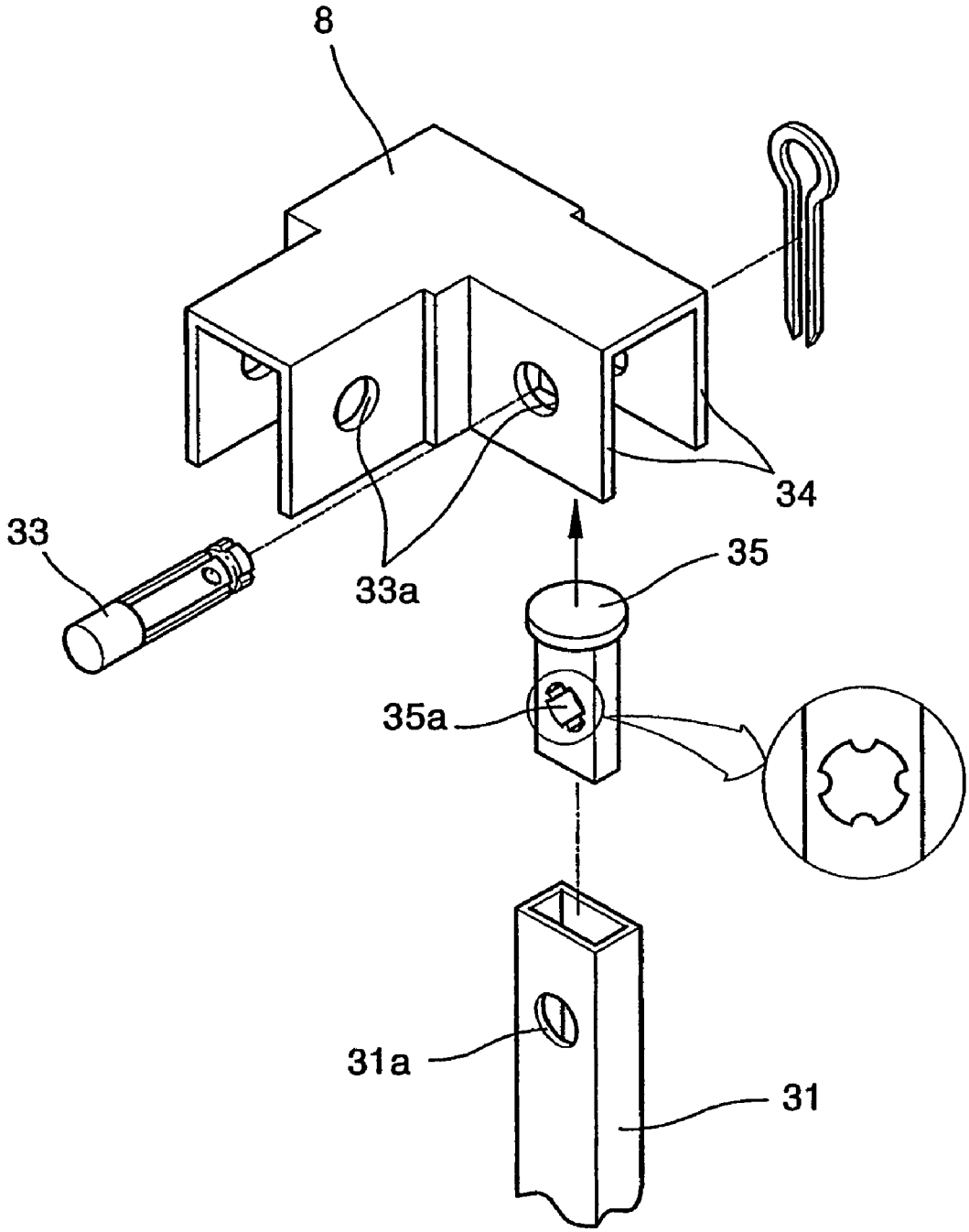
FIG. 4A is an exploded perspective view illustrating an example of a pillar end portion connection block of FIG. 1B.
Figure 4B:
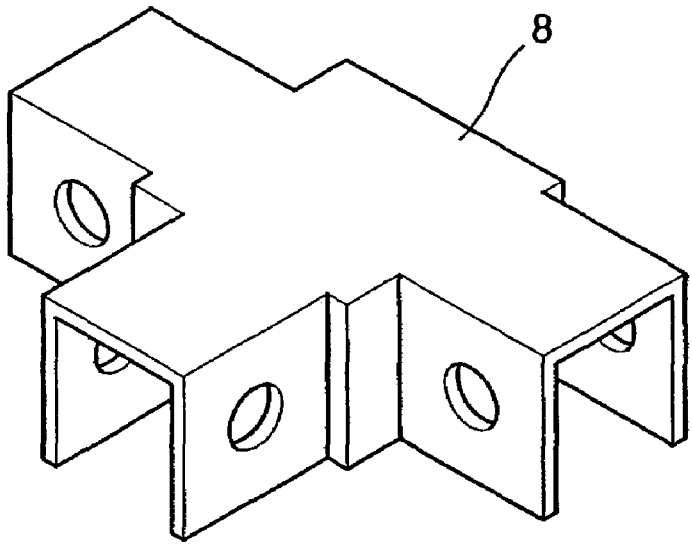
FIG. 4B is a perspective view illustrating another example of an extendable pillar end portion connection block of FIG. 1B.
Figure 4C:
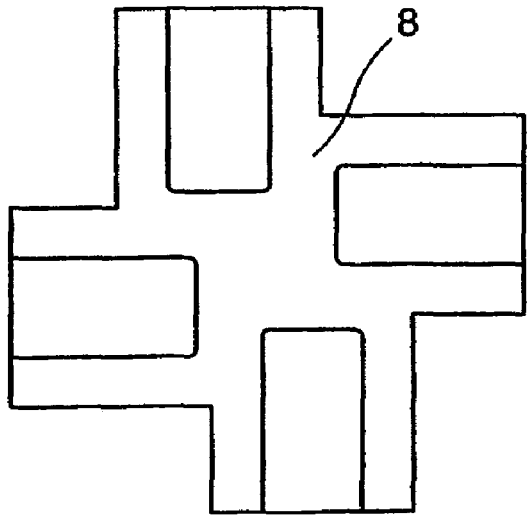
FIG. 4C is a sectional view illustrating an example of a head connection block of FIG. 1B.
Figure 4D:
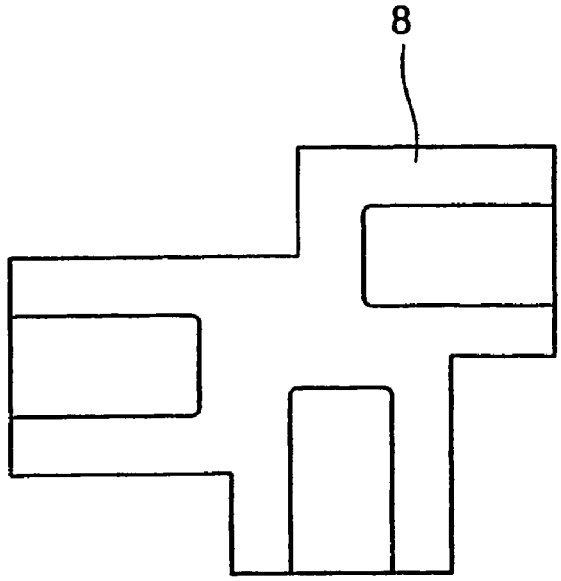
FIG. 4D is a sectional view illustrating an example of a rod connection block of FIG. 1B.
Figure 4E:
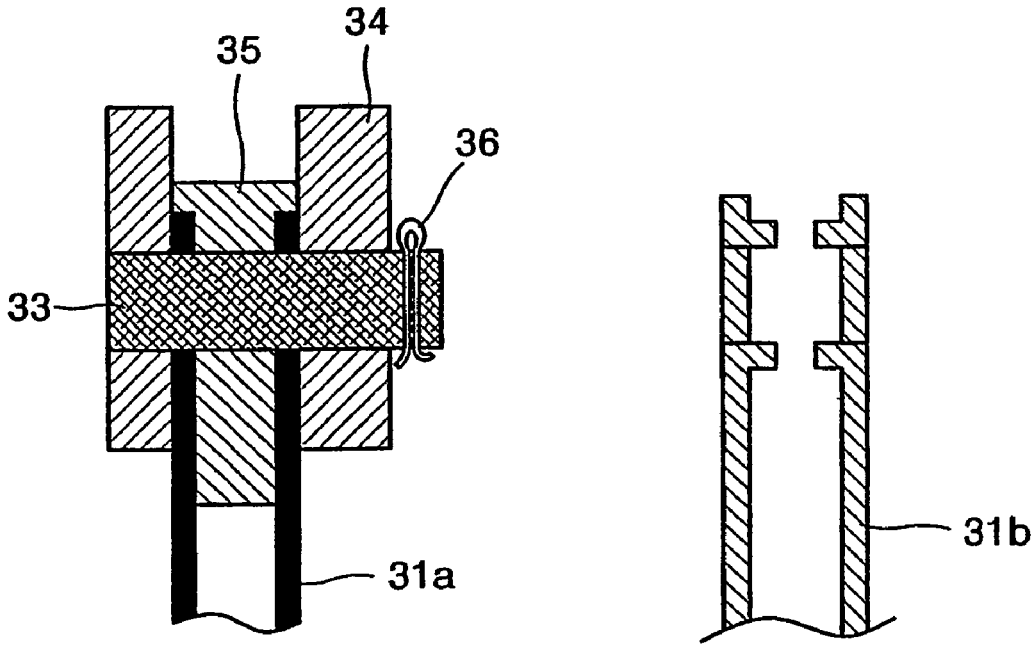
FIG. 4E is a sectional view illustrating an example of a state in which the connection block and the rod of FIG. 1B are coupled.

That is, as shown in FIG. 4A, an arm 34 is formed such that the first and second rods 31 and 32 are pivot coupled by a hinge shaft 33 penetrating a pin hole 31*a* formed in the first and second rods 31 and 32 and a pin hole 33*a* formed in the connection block.

Here, a spline groove having a corrugated shape are formed on an inner diametric surface of the pin hole 31*a* formed in the first rods 31 and 31 and the second rods 32 and 42. A spline protrusion having a corrugated shape corresponding to the spline groove 35*a* is formed on an outer surface of the hinge shaft 33 penetrating the pin hole 31*a*. During rotation of a hinge, a pin is rotated in the hinge where the hinge shaft 33 and the first rod 31 or the second rod 32 are connected. A cap or pin 36 is fixed to an end portion of the hinge shaft 33 to make coupling firm.

The pin hole 31*a* formed at the end portion of the first and second rods 31 and 32 is preferably formed by directly pressure punching the end portion of the first and second rods 31 and 32. As shown in FIG. 4A, the pin hole 31*a* is formed in a separate injection mold 35 and the pin hole 31*a* is formed at the first and second rods 31 and 32. Thus, the hinge shaft 33 penetrates the pin hole 31*a* of the injection mold 35 and the pin hole 31*a* of the first rod 31 or the second rod 32 so that the injection mold 35 and the first rod 31 or the second rod 32 can be firmly fixed by capping the end portion of the hinge shaft 33 using a pin or cap.

Figure 6A:
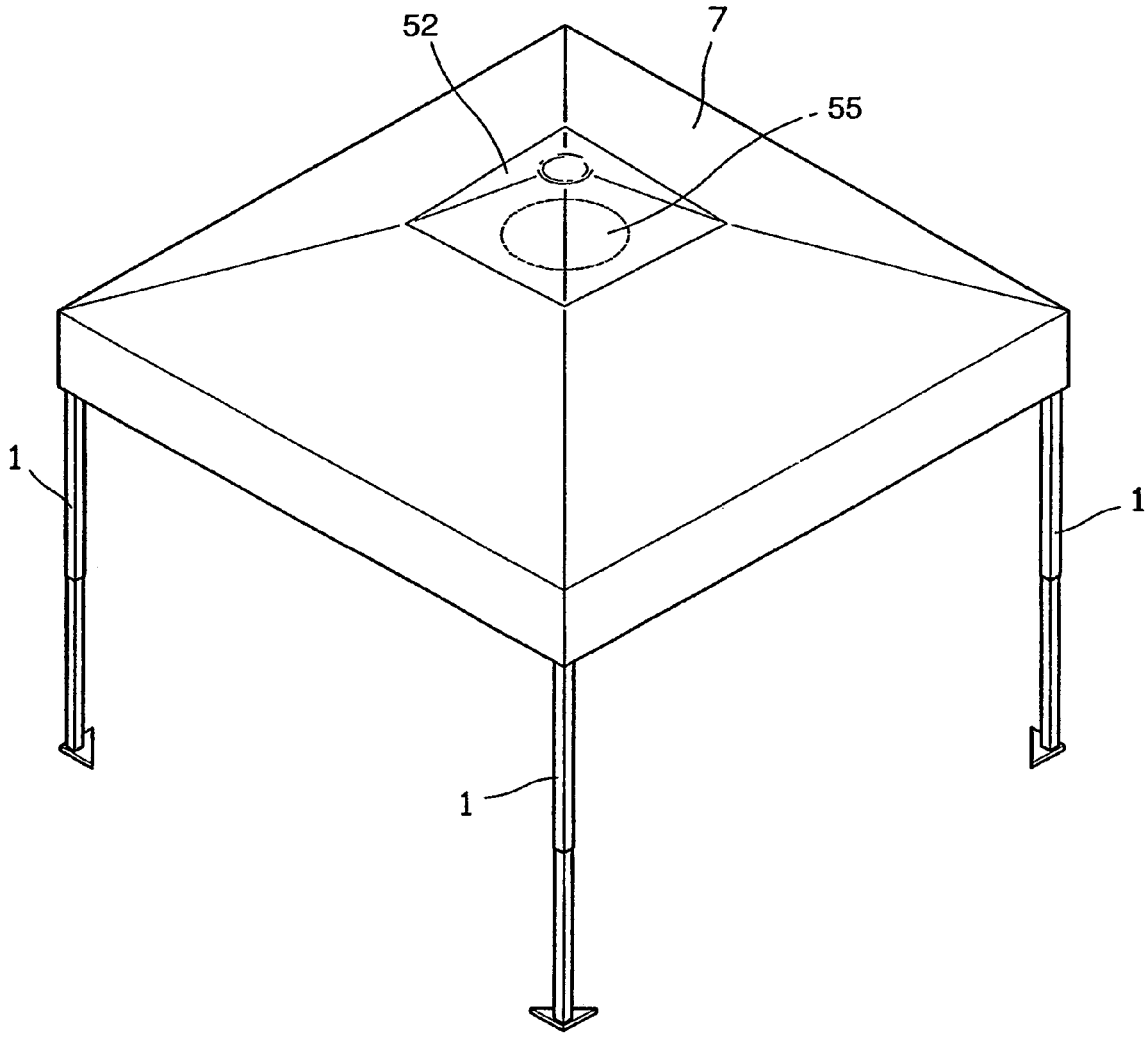
FIGS. 6A and 6B are perspective view illustrating the structure of a single roof canopy according to still yet further another preferred embodiment of the present invention.
Figure 6B:
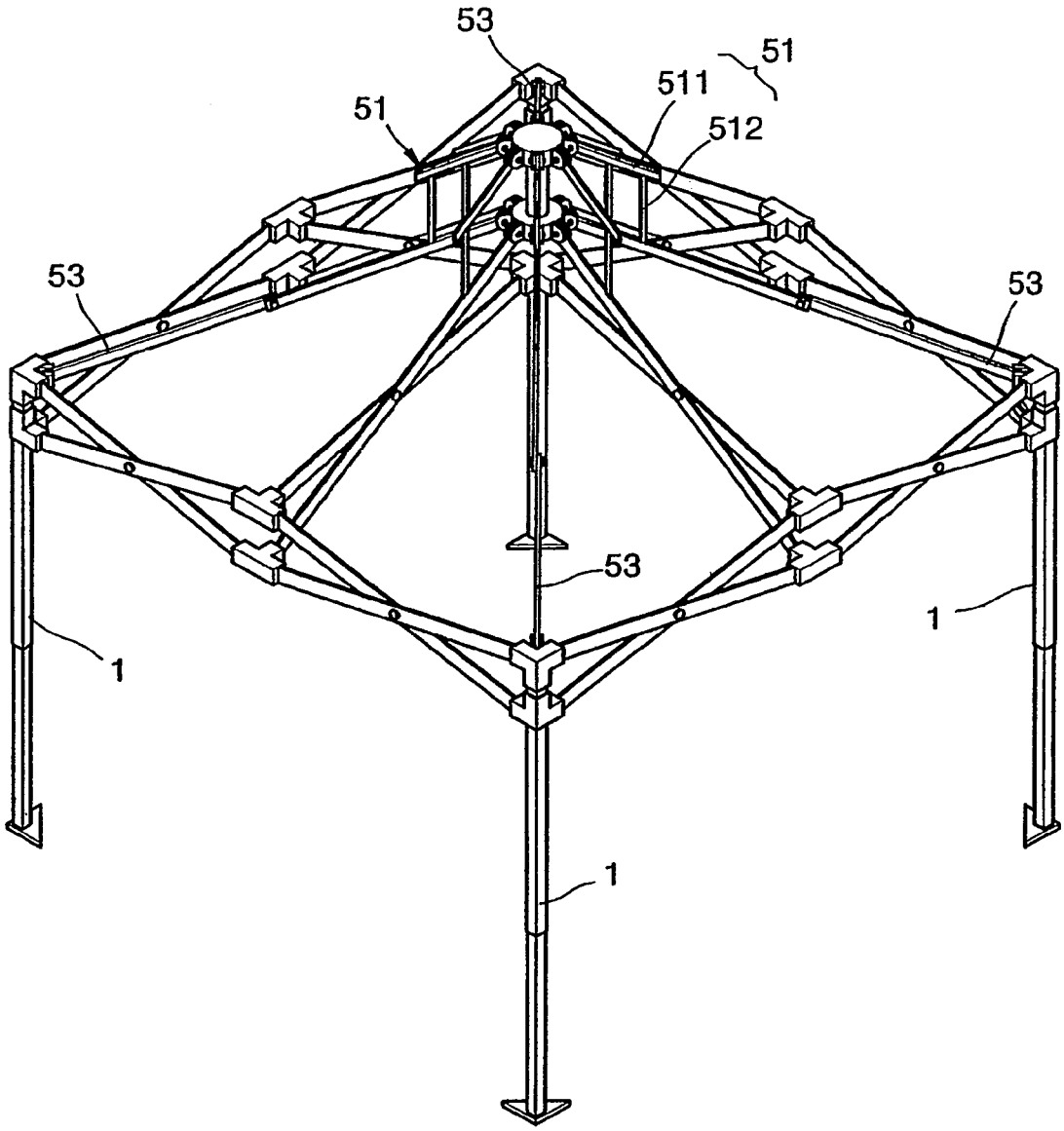

As shown in FIGS. 6A and 6B, in the structure of the canopy according to another preferred embodiment of the present invention, a ventilating opening 55 is formed at the sharp center of the roof cloth 7. The upper head connection block 5 protrudes upward by penetrating the ventilating opening 55. A hinged sunshield roof rib 51 is formed at the upper head connection block 5 separated a predetermined distance from the ventilating opening 55, so that a double storied sunshield roof 52 is installed.

The double storied sunshield roof 52 has a diameter greater than that of the ventilating opening 55 so that sunshine falling on the ventilating opening 55 can be completely shielded.

Accordingly, a user can keep the canopy by folding the frame using the hinge and opens the canopy by slightly widening the pillar 1, as shown in FIG. 6B. Then, as shown in FIG. 6A, the canopy is completed by covering the completed double storied sunshield roof 52 with the roof cloth where the ventilating opening 55 is formed.

The sunshield roof rib 51 supporting the double storied sunshield roof 52, as shown in FIG. 6B, includes a radial sunshield roof rib 511 and a hinged sunshield roof rib 512. The radial sunshield roof rib 511 forms a frame for the sunshield roof 52 while the hinged sunshield roof rib 512 supports opening of the radial sunshield roof rib 511 when the frame is opened.

Also, the above two storied sunshield roof 52 can be installed as a double unit canopy by further installing two more pillars 1, the roof edge frame 3 and the roof center frame 4 to form two units of the upper head connection block 5 and the lower head connection block 6, four corner reinforcement bars 53 shown in FIG. 5B when the strength needs to be reinforced, and one more double storied sunshield roof 52. In addition to the above structure, if necessary, multiple units such as three units or four units can be formed by further installing the pillar 1, the roof edge frame 3, the roof center frame 4, and the corner reinforcement bar 53.

Figure 7A:
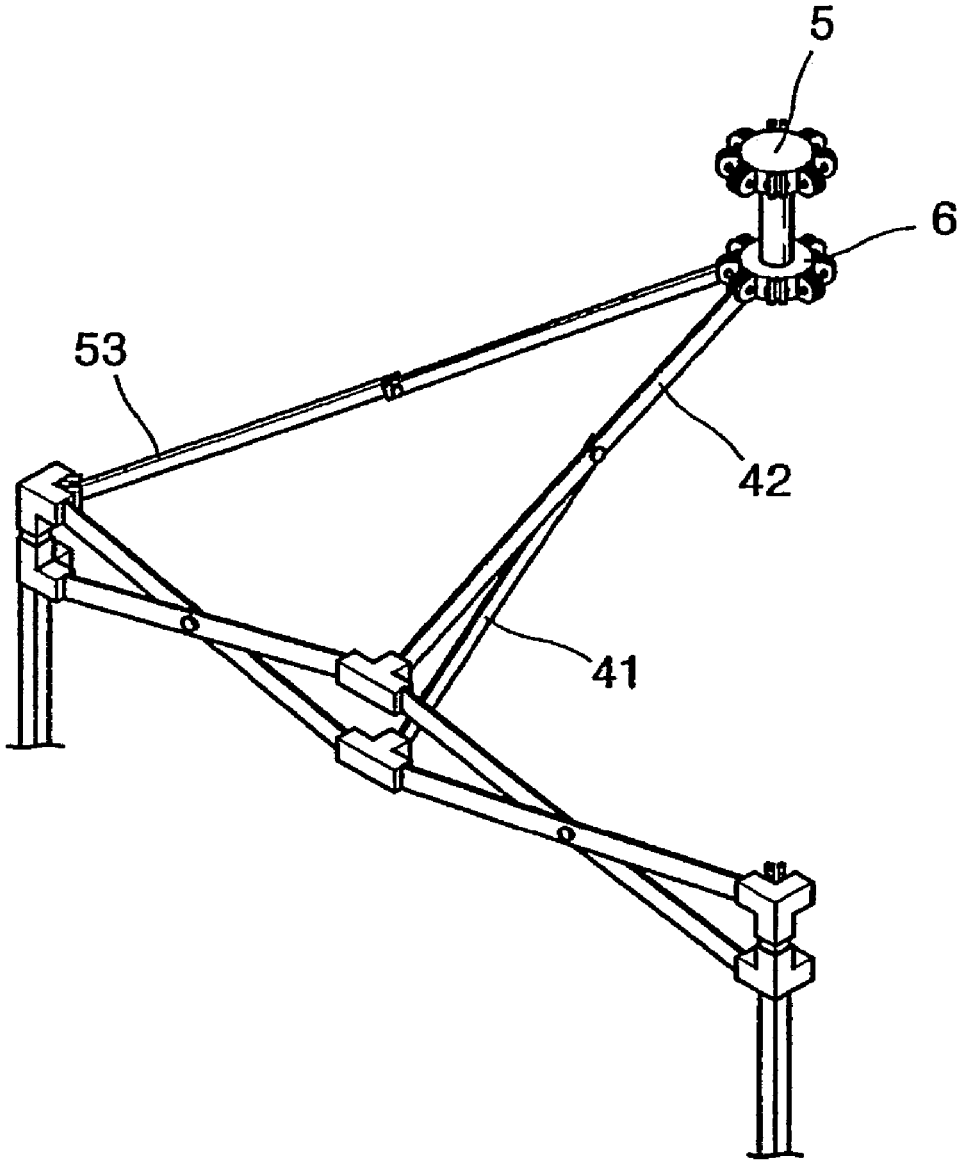
FIGS. 7A, 7B, and 7C are perspective views illustrating the structure of connection of the first and second rods of the roof center frame of FIG. 6B and an example of a truss (rods) adopted in the canopies of FIGS. 3A through 3E.
Figure 7B:
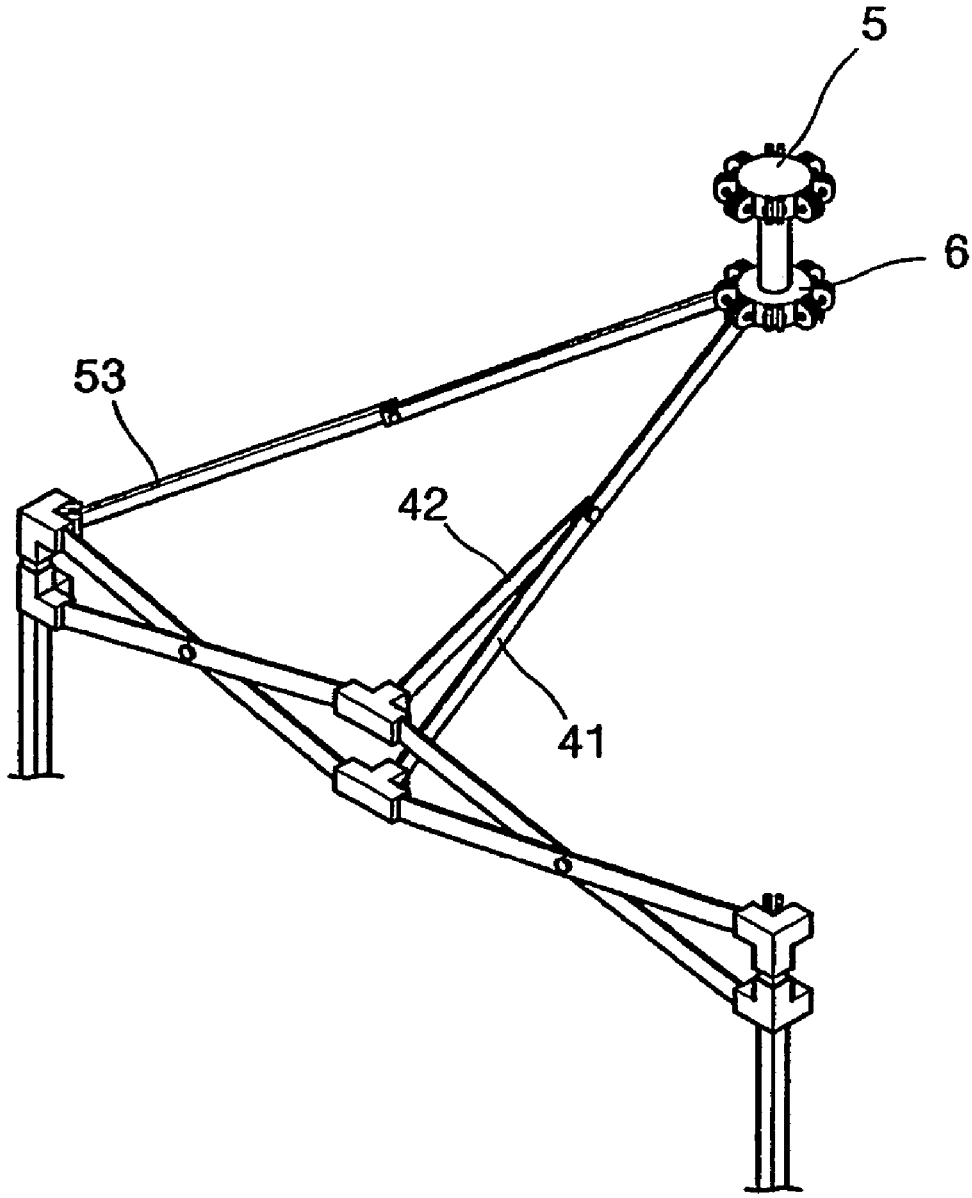
Figure 7C:
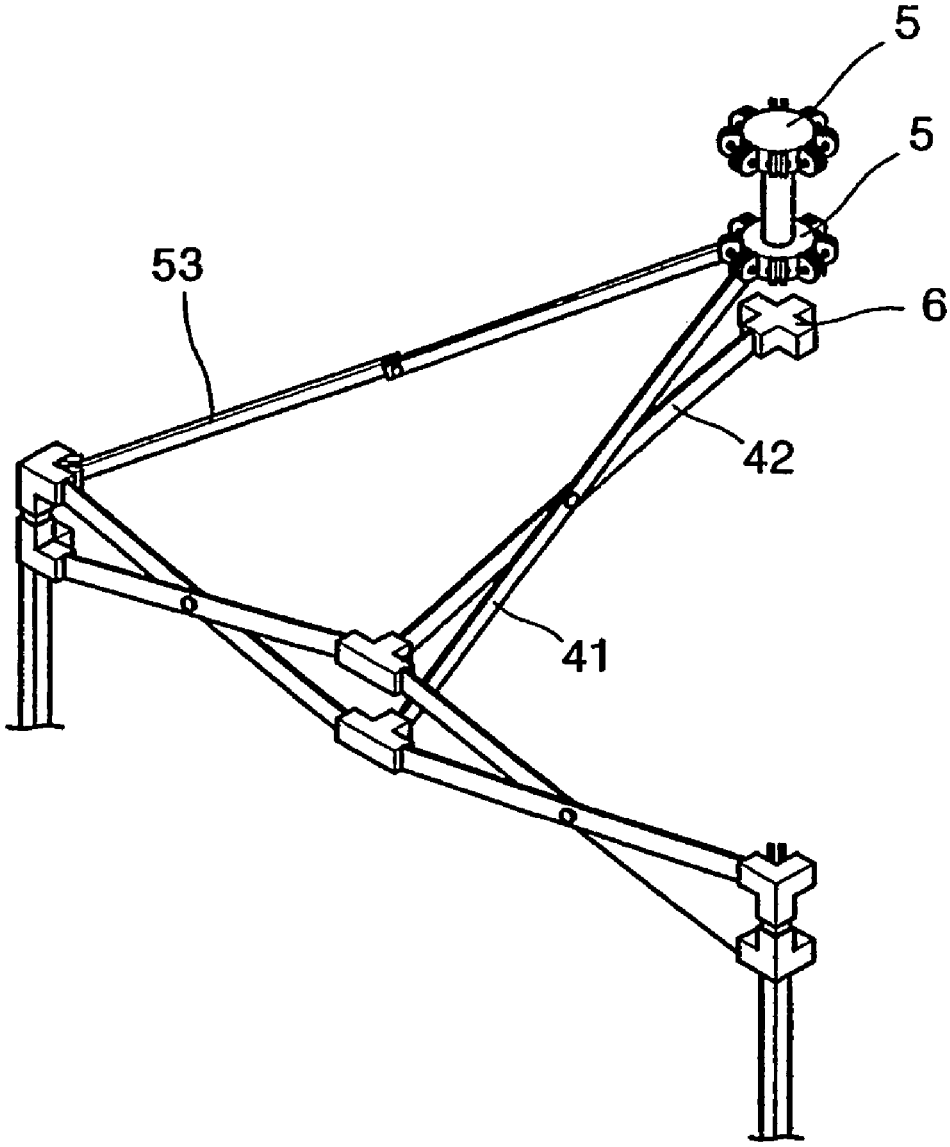

As shown in FIGS. 7A, 7B, and 7C, the shape of the first rod 41, the second rod 42, and the third rod 53 of the roof center frame 4 of the hinged sunshield roof rib 512 of which one end pivots can be manufactured in various ways according to the purpose or the strength of wind. As shown in FIG. 7A, the first rod 41 can pivot with respect to a slide bar which slides to push and erect the second rod 42. As shown in FIG. 7B, the second rod 42 can pivot with respect to the first rod 41 which slides to pull and erect the first rod 41. As shown in FIG. 7C, the first rod 41 and the second rod 42 can pivot crossing each other in "X" form. Also, the third rod 53 can be included or excluded according to the strength or purpose.

Figure 8A:
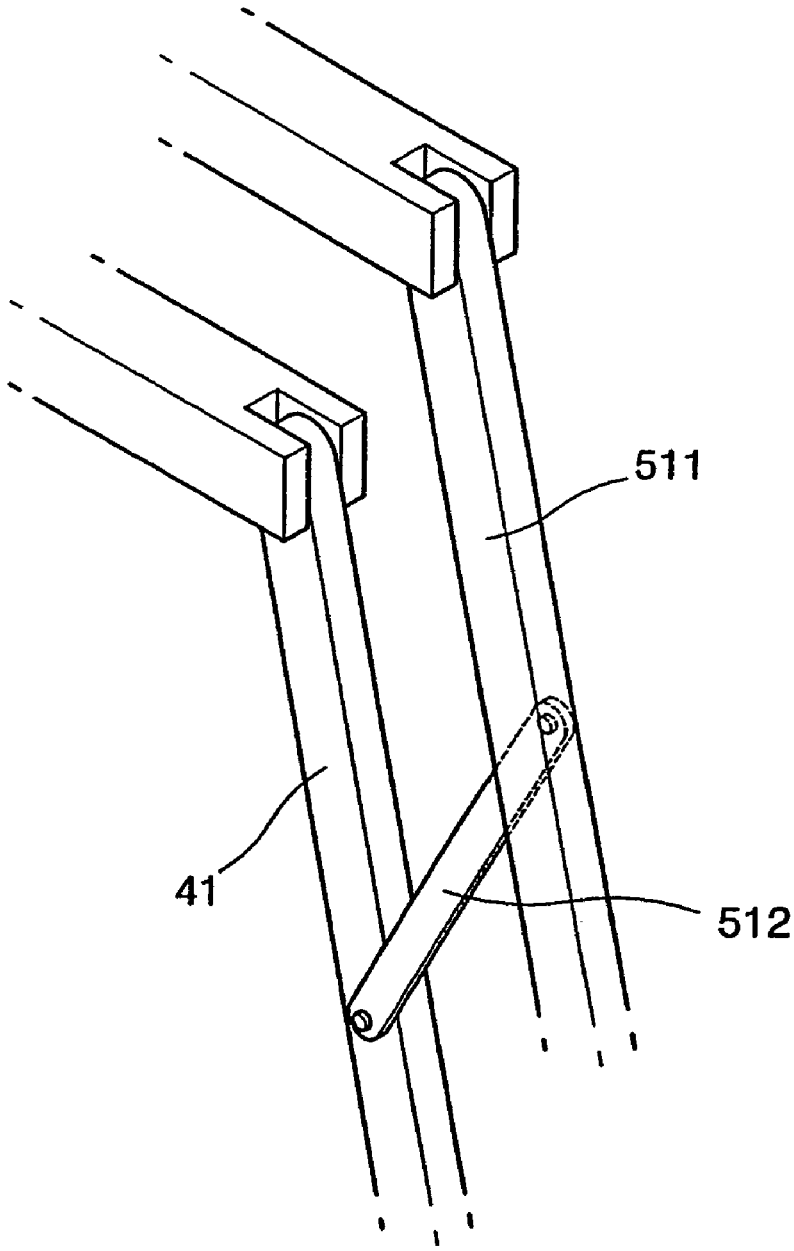
FIGS. 8A and 8B are perspective views illustrating examples of a hinge type sunshield spokes of FIG. 6B.
Figure 8B:
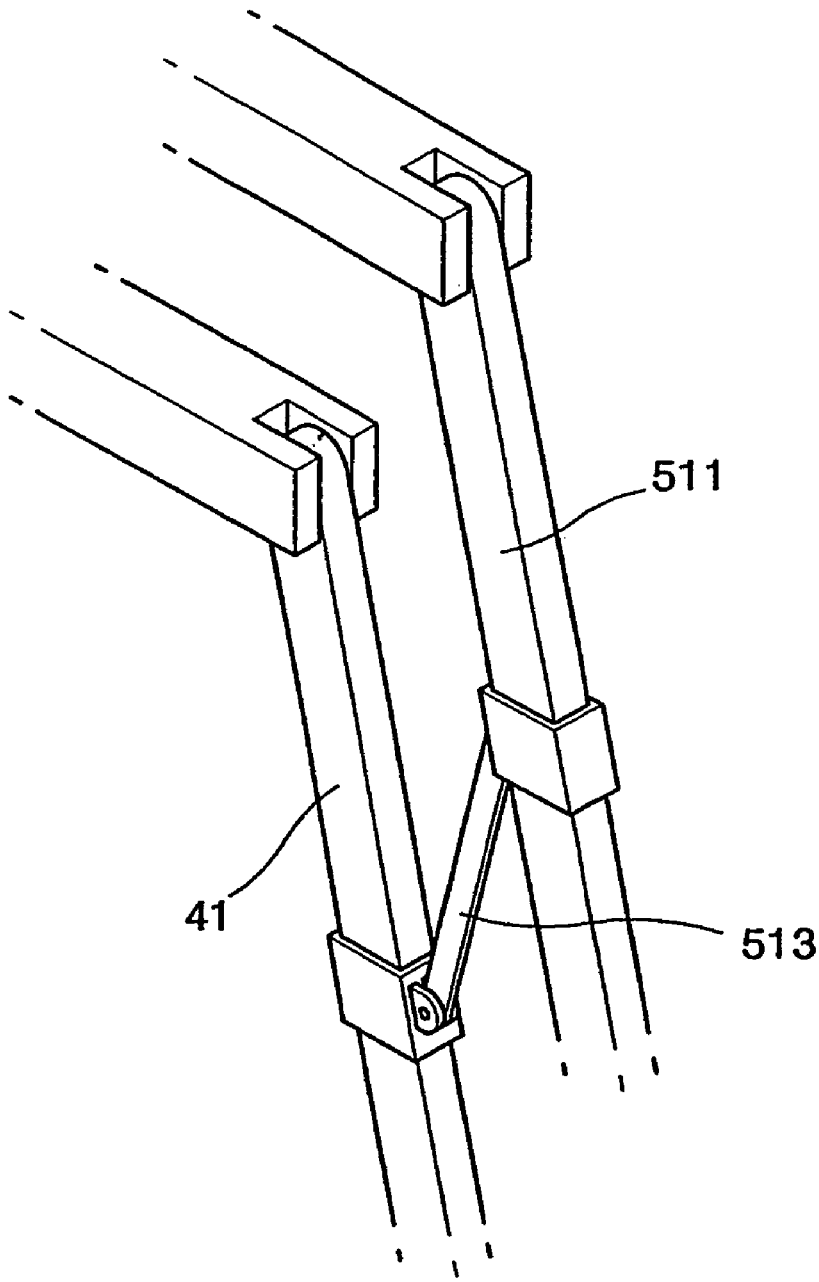

Also, as shown in FIGS. 8A and 8B, the hinged sunshield roof rib 512 can be manufactured in a various shapes such as a linear, curved, or bent form. As shown in FIG. 8A, the hinged sunshield roof rib 512 is hinged at the central portion of the radial sunshield roof rib 511 or at the position deviated from the central portion. As shown in FIG. 8B, both ends of the hinged sunshield roof rib 512 can pivot with respect to a pair of hinged sunshield roof ribs capable of sliding along the radial sunshield roof rib 511 or the first rod 41 or fixed and hinged thereto.

Thus, the roof edge frame 3 and the roof center frame 4 include rods having different lengths and various shapes, forming various shapes of a roof. Also, the outer appearance of the roof can be improved, and the corner portion of the roof can be firmly supported.

Also, the roof can be easily formed into a multiunit. A damage to a user who manipulates the snap button 11 using the key lever can be prevented. Ventilation in the roof is smooth. Products can be made luxury and simultaneously internal air circulation is made smooth so that the temperature can be controlled.

For, example, although the preferred embodiment of the present invention is limited to the single and double units canopy, a variety of units of canopy is possible by connecting a plurality of units. The structure of a canopy according to the present invention can be adopted in various types of canopies such as a pyramid type roof, a slate (gable) type roof, a cross type roof, a cross-pyramid type roof, and a modified cross-pyramid type roof according to various shape and type of roofs. Thus, smooth ventilation and aesthetic appearance are possible.

Thus, the range of claiming rights in the present invention will not be determined within a range of the above detailed description, but should be limited by the following claims and the technical concept of the present invention.

As described above, in the structure of a canopy according to the present invention, the structure of a canopy can be adopted in various types of canopies such as a pyramid type roof, a slate (gable) type roof, a cross type roof, a cross-pyramid type roof, and a modified cross-pyramid type roof according to various shape and type of roofs. Thus, smooth drainage and aesthetic appearance are possible. Endurance and sustenance to an external force is improved by reinforcing the corner of the roof, if necessary, A user is kept safe from a damage occurring during use of the key lever. By forming a ventilation opening and two storied sunshield roof at the roof, internal ventilation is made smooth and an increase in temperature can be prevented. Products can be made luxury. Also, since the ventilation opening and the two storied sunshield roof can be removed, the canopy can be used in two purposes according to the season and temperature under various circumstances.

What is claimed is:

1. A structure of a canopy comprising:

a plurality of pillars erected on the ground;

an end portion connection block fixed to an end portion of the pillar;

a slide connection block capable of sliding along the pillar;

a plurality of roof edge frames, each supporting an edge of a roof and including a first rod pivoting with respect to the end portion connection block of the pillar and a second rod pivoting with respect to the slide connection block, so that a center portion of the first and second rods pivots in X form capable of being hinge coupled;

a plurality of roof center frames, each supporting a center portion of the roof and including a first rod pivoting with respect to the end portion connection block of the first rod of the roof edge frame and a second rod pivoting with respect to the end portion connection block of the second rod of the roof edge frame, so that a center portion of the first and second rods pivots in X form capable of being hinge coupled;

a rod connection block connecting the roof edge frame and the roof center frame;

an upper head connection block pivoting with respect to the first rod of each of the roof center frames to form an outer top end of the roof;

a lower head connection block pivoting with respect to the second rod of each of the roof center frames to form an inner top end of the roof;

a connection block including a corner reinforcement bar capable of being hinge coupled between the end portion connection block and the upper head connection block to reinforce a corner formed to face the center of the roof; and a roof cloth covering the roof edge frame and the roof center frame, wherein the slide connection block comprises:

a main body which is an injection mold block where a cylindrical rail is formed on the bottom surface;

a slide key lever which is a column type injection block capable of sliding by being inserted in the rail of the main body and having a leading end portion inserted in a through hole formed in the pillar when a user presses the slide key lever to slidingly advance;

an elastic spring inserted around a leading end portion of the slide key lever and installed between the main body and the slide key lever to apply a restoring force in a direction to retreat the slide key lever; and a key lever fixing tool which is a latch caught by a hook groove formed in the slide key lever and inserted in a vertical hole formed in a fixing cap covering and fixing the slide key lever and lowered by its own weight so that, as the leading end portion is caught by the hook groove of the slide key lever, when the slide key lever is in an advanced state, the slide key lever is fixed.

2. A structure of a canopy comprising:

a plurality of pillars erected on the ground;

an end portion connection block fixed to an end portion of the pillar;

a slide connection block capable of sliding along the pillar;

a plurality of roof edge frames, each supporting an edge of a roof and including a first rod pivoting with respect to the end portion connection block of the pillar and a second rod pivoting with respect to the slide connection block, so that a center portion of the first and second rods pivots in X form capable of being hinge coupled;

a plurality of roof center frames, each supporting a center portion of the roof and including a first rod pivoting with respect to the end portion connection block of the first rod of the roof edge frame and a second rod pivoting with respect to the end portion connection block of the second rod of the roof edge frame, so that a center portion of the first and second rods pivots in X form capable of being hinge coupled;

a rod connection block connecting the roof edge frame and the roof center frame;

an upper head connection block pivoting with respect to the first rod of each of the roof center frames to form an outer top end of the roof;

a lower head connection block pivoting with respect to the second rod of each of the roof center frames to form an inner top end of the roof;

a connection block including a corner reinforcement bar capable of being hinge coupled between the end portion connection block and the upper head connection block to reinforce a corner formed to face the center of the roof; and a roof cloth covering the roof edge frame and the roof center frame, wherein the slide connection block comprises:

a main body which is an injection molding block where a guide plate is formed at a side surface thereof;

a rotary key lever which is a rotary plate type injection block capable of pivoting around a pivot shaft installed on the guide plate of the main body, rotated by an elastic spring when a user opens the canopy by raising the slide connection block, so that a tip end portion formed on one side thereof is inserted in a through hole formed in the pillar; and the elastic spring inserted around a tailing portion at the other side of the rotary key lever and installed between the main body and the rotary key lever and applying a restoring force in a direction to rotate the rotary key lever.

3. The structure of a canopy as claimed in claim 1 or 2, wherein a multiunit roof is installed by further installing the pillars, the roof edge frames, and the roof center frames to form a plurality of the upper head connection block and the lower head connection blocks.

4. The structure of a canopy as claimed in claim 1 or 2, wherein the slide connection block further comprises:

a key lever handle which is a handle having one end screw-coupled or fixed to a screw hole formed in a side surface of the slide key lever and the other end protruding from a slide hole formed in a side surface of the main body, so that, when a user retreats the slide key lever in an advanced state, the pillar is freely moved.

5. The structure of a canopy as claimed in claim 1 or 2, wherein the slide connection block, the end portion connection block of the pillar, the rod connection block and the rod connection block of the first rod of the roof edge frame, the upper head connection block, and the lower head connection block are plastic injection structures or welding structures according to the use thereof, have rectangular, square, circular, or oval shapes according to the shape of a rod in use, have an arm coupled via a column or cylindrical hinge shaft where a spline penetrating pin holes formed in the first and second rods of each of the blocks and a pin hole formed in the connection block, capable of pivoting, and have a fixing cap or pin installed at one end of the hinge shaft.

6. The structure of a canopy as claimed in claim 1 or 2, wherein a ventilation opening is formed at a sharp center of the roof cloth, the upper head connection block which is a plastic injection mold or a welding structure penetrates the ventilation opening to protrude upward, an additional double storied sunshield roof where hinge type sunshield roof ribs are formed is installed at the upper head connection block separated a predetermined distance from the ventilation opening.

7. The structure of a canopy as claimed in claim 1 or 2, wherein the sunshield roof ribs comprises:

radial sunshield roof ribs forming the sunshield roof; and hinge type sunshield roof ribs having one end portion pivoting at a center portion of the radial sunshield roof ribs or deviated from the center portion, sliding along the radial sunshield roof ribs, or fixed to the radial sunshield roof ribs capable of being folded by a hinge, and the other end portion pivoting the corner reinforcement bar and/or the second rod of the roof center frame.

8. The structure of a canopy as claimed in claim 1 or 2, wherein an upper roof column capable of sliding along the upper head connection block is installed on the lower head connection block by penetrating the upper head connection block, a second elastic spring is installed under the upper roof column and in a lower roof column to enable height adjustment by erecting the upper roof column, and a rotary handle is installed on the lower head connection block capable of freely rotating to adjust the displacement of the second elastic spring and having one end portion penetrating the second elastic spring and fixed to an end portion of the second elastic spring capable of freely rotating and the other end portion capable of advancing and retreating by mean of a nut and a screw with respect to the lower head connection block during rotation.

9. The structure of a canopy as claimed in claim 2, wherein, in the pillar, a key lever fixing block is inserted in an outer pipe and the outer pipe slide along an inner pipe to adjust the height of the pillar, a key lever or a snap button elastically hooked by a through hole formed in the outer pipe is selectively installed on the inner pipe according to use, and a fixing block fixing the inner and outer pipes is installed on the outer pipe, wherein the fixing block comprises: a main body which is an injection molding block where a rail is formed; a slide key lever which is a column type injection block inserted in the rail of the main body and sliding thereon and having a leading end portion penetrating the outer and inner pipes when advancing; a third elastic spring inserted around a rear end portion of the slide key lever and installed between the fixing cap and the slide key lever to act a restoration force in a direction to advance the slide key lever; and a key lever handle which is a handle having one end screw coupled or coupled to a screw groove formed in a side surface of the slide key lever and the other end protruding from a slide hole formed in a side surface of the main body, so that the inner pipe moves freely by retreating the slide key lever in an advanced state.

10. The structure of a canopy as claimed in claim 3, wherein the multiunit roof is a single-roof multiunit manufactured by removing the central pillar and connecting a plurality of small roofs.

11. The structure of a canopy as claimed in claim 3, wherein the multiunit roof is a double-roof multiunit manufactured by removing the central pillar and forming a single large roof.

12. A structure of a canopy comprising:

a plurality of pillars erected on the ground;

an end portion connection block fixed to an end portion of the pillar;

a slide connection block capable of sliding along the pillar;

a plurality of roof edge frames, each supporting an edge of a roof and including a first rod pivoting with respect to the end portion connection block of the pillar and a second rod pivoting with respect to the slide connection block, so that a center portion of the first and second rods pivots in X form capable of being hinge coupled;

a plurality of roof center frames, each supporting a center portion of the roof and including a first rod pivoting with respect to the end portion connection block of the first rod of the roof edge frame and a second rod pivoting with respect to the end portion connection block of the second rod of the roof edge frame, so that a center portion of the first and second rods pivots in X form capable of being hinge coupled;

a rod connection block connecting the roof edge frame and the roof center frame;

an upper head connection block pivoting with respect to the first rod of each of the roof center frames to form an outer top end of the roof;

a lower head connection block pivoting with respect to the second rod of each of the roof center frames to form an inner top end of the roof;

a connection block including a corner reinforcement bar capable of being hinge coupled between the end portion connection block and the upper head connection block to reinforce a corner formed to face the center of the roof;

a roof cloth covering the roof edge frame and the roof center frame, wherein, to make the upper head connection block disposed higher than the height of a horizontal level of the roof edge frame when the canopy is open, the rod of the roof center frame is longer than the rod of the roof edge frame and the first rod of the roof center frame is longer than the second rod of the roof center frame and the second rod of the roof edge frame is longer than the first rod of the roof edge frame, so that the canopy has one of a pyramid type roof, a slate (gable) type roof, a cross type roof, a cross-pyramid type roof, and a modified cross-pyramid type roof, and wherein the slide connection block comprises:

a main body which is an injection mold block where a cylindrical rail is formed on the bottom surface;

a slide key lever which is a column type injection block capable of sliding by being inserted in the rail of the main body and having a leading end portion inserted in a through hole formed in the pillar when a user presses the slide key lever to slidingly advance;

an elastic spring inserted around a leading end portion of the slide key lever and installed between the main body and the slide key lever to apply a restoring force in a direction to retreat the slide key lever; and a key lever fixing tool which is a latch caught by a hook groove formed in the slide key lever and inserted in a vertical hole formed in a fixing cap covering and fixing the slide key lever and lowered by its own weight so that, as the leading end portion is caught by the hook groove of the slide key lever, when the slide key lever is in an advanced state, the slide key lever is fixed.

13. A structure of a canopy comprising:

a plurality of pillars erected on the ground;

an end portion connection block fixed to an end portion of the pillar;

a slide connection block capable of sliding along the pillar;

a plurality of roof edge frames, each supporting an edge of a roof and including a first rod pivoting with respect to the end portion connection block of the pillar and a second rod pivoting with respect to the slide connection block, so that a center portion of the first and second rods pivots in X form capable of being hinge coupled;

a plurality of roof center frames, each supporting a center portion of the roof and including a first rod pivoting with respect to the end portion connection block of the first rod of the roof edge frame and a second rod pivoting with respect to the end portion connection block of the second rod of the roof edge frame, so that a center portion of the first and second rods pivots in X form capable of being hinge coupled;

a rod connection block connecting the roof edge frame and the roof center frame;

an upper head connection block pivoting with respect to the first rod of each of the roof center frames to form an outer top end of the roof;

a lower head connection block pivoting with respect to the second rod of each of the roof center frames to form an inner top end of the roof;

a connection block including a corner reinforcement bar capable of being hinge coupled between the end portion connection block and the upper head connection block to reinforce a corner formed to face the center of the roof;

a roof cloth covering the roof edge frame and the roof center frame, wherein, to make the upper head connection block disposed higher than the height of a horizontal level of the roof edge frame when the canopy is open, the rod of the roof center frame is longer than the rod of the roof edge frame and the first rod of the roof center frame is longer than the second rod of the roof center frame and the second rod of the roof edge frame is longer than the first rod of the roof edge frame, so that the canopy has one of a pyramid type roof, a slate (gable) type roof, a cross type roof, a cross-pyramid type roof, and a modified cross-pyramid type roof, and;

wherein the slide connection block comprises:

a main body which is an injection molding block where a guide plate is formed at a side surface thereof;

a rotary key lever which is a rotary plate type injection block capable of pivoting around a pivot shaft installed on the guide plate of the main body, rotated by an elastic spring when a user opens the canopy by raising the slide connection block, so that a tip end portion formed on one side thereof is inserted in a through hole formed in the pillar; and the elastic spring inserted around a tailing portion at the other side of the rotary key lever and installed between the main body and the rotary key lever and applying a restoring force in a direction to rotate the rotary key lever.

* * * * *

UNITED STATES PATENT AND TRADEMARK OFFICE

CERTIFICATE OF CORRECTION

PATENT NO. : 7,422,026 B2
APPLICATION NO. : 10/500926
DATED : September 9, 2008
INVENTOR(S) : Dae Hwan Kim It is certified that error appears in the above-identified patent and that said Letters Patent is hereby corrected as shown below:

On the Title page, please insert the following:

Item --(30) Foreign Application Priority Data

January 8, 2002 (KR) ..... 10-2002-0000982
January 3, 2003 (KR) ..... 10-2003-0000366--

Signed and Sealed this

Twenty-seventh Day of January, 2009

John Doll

JOHN DOLL
*Acting Director of the United States Patent and Trademark Office*